US006334720B1

(12) United States Patent
Kato et al.

(10) Patent No.: US 6,334,720 B1
(45) Date of Patent: Jan. 1, 2002

(54) PRINTING APPARATUS AND METHOD FOR CORRECTING PRINT POSITIONS

(75) Inventors: Masao Kato; Hiroyuki Saito, both of Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/422,097

(22) Filed: Oct. 20, 1999

(30) Foreign Application Priority Data

Oct. 23, 1998 (JP) ..... 10-302806

(51) Int. Cl.[7] ..... B41J 3/42; B41J 2/00
(52) U.S. Cl. ..... 400/74; 400/118.2
(58) Field of Search ..... 400/74, 118.2

(56) References Cited

U.S. PATENT DOCUMENTS

| | | | | |
|---|---|---|---|---|
| 4,313,124 A | | 1/1982 | Hara | |
| 4,345,262 A | | 8/1982 | Shirato et al. | |
| 4,459,600 A | | 7/1984 | Sato et al. | |
| 4,463,359 A | | 7/1984 | Ayata et al. | |
| 4,558,333 A | | 12/1985 | Sugitani et al. | |
| 4,723,129 A | | 2/1988 | Endo et al. | |
| 4,740,796 A | | 4/1988 | Endo et al. | |
| 5,404,020 A | * | 4/1995 | Cobbs | 250/548 |
| 5,448,269 A | * | 9/1995 | Beauchamp et al. | 347/19 |
| 5,796,414 A | * | 8/1998 | Sievert et al. | 347/19 |
| 6,003,970 A | | 12/1999 | Fujita et al. | |
| 6,076,915 A | * | 6/2000 | Gast et al. | 347/19 |

FOREIGN PATENT DOCUMENTS

| | | | |
|---|---|---|---|
| EP | 0540244 A | 5/1993 | B41J/25/304 |
| EP | 0622237 A2 | 11/1994 | B41J/25/34 |
| EP | 0858897 A1 | 8/1998 | B41J/2/21 |
| EP | 0869007 A2 | 10/1998 | B41J/2/21 |
| EP | 0895869 A2 * | 10/1999 | |
| JP | 54-56847 | 5/1979 | |
| JP | 59-123670 | 7/1984 | |
| JP | 59-138461 | 8/1984 | |
| JP | 60-71260 | 4/1985 | |

* cited by examiner

*Primary Examiner*—John S. Hilten
*Assistant Examiner*—Charles H. Nolan, Jr.
(74) *Attorney, Agent, or Firm*—Fitzpatrick, Cella, Harper & Scinto

(57) ABSTRACT

In the print position adjustment procedure when performing bidirectional printing by using a first head and a second head, patterns (A) and (B) are printed to adjust the print positions of the first and second heads relative to each other in each of the forward and backward directions. A pattern (C) is printed to adjust the print position deviation of one of the two heads (first head) between the forward and backward directions. From these patterns three correction values are obtained to perform corrections. This allows the print position alignment between the forward and backward scans for one head (first head) to be performed by using the pattern (C). The print position alignment of the second head with respect to the first head as a reference in each of the forward and backward directions can be performed by using the patterns (A) and (B). As a result, print position deviations that may occur when the printing apparatus performs bidirectional printing using a plurality of heads can be minimized without having to maintain the precision of the apparatus at so high a level.

18 Claims, 21 Drawing Sheets

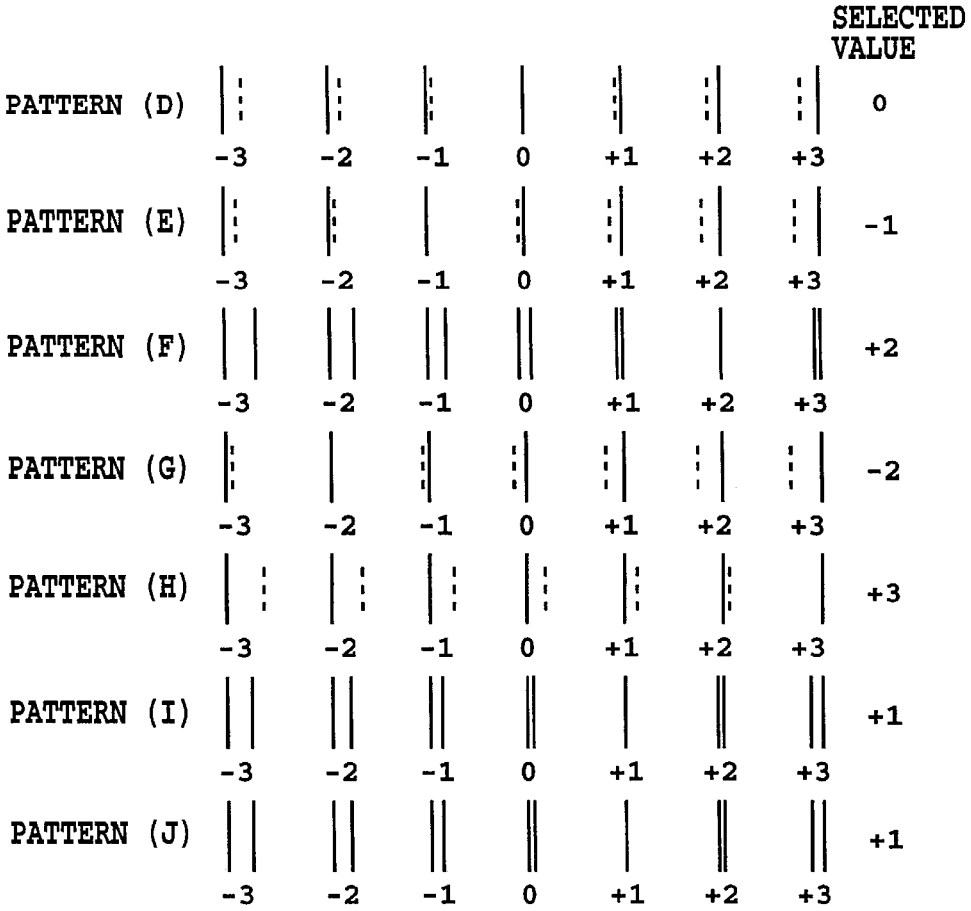

FIRST CARRIAGE SPEED (D) ADJUSTMENT PATTERN FOR PRINT POSITION DEVIATION BETWEEN FIRST AND SECOND HEADS IN FIRST SCAN DIRECTION (E) ADJUSTMENT PATTERN FOR PRINT POSITION DEVIATION BETWEEN FIRST AND SECOND HEADS IN SECOND SCAN DIRECTION (F) ADJUSTMENT PATTERN FOR PRINT POSITION DEVIATION BETWEEN FIRST SCAN DIRECTION AND SECOND SCAN DIRECTION (PRINTED BY FIRST HEAD)

SECOND CARRIAGE SPEED (G) ADJUSTMENT PATTERN FOR PRINT POSITION DEVIATION BETWEEN FIRST AND SECOND HEADS IN FIRST SCAN DIRECTION (H) ADJUSTMENT PATTERN FOR PRINT POSITION DEVIATION BETWEEN FIRST AND SECOND HEADS IN SECOND SCAN DIRECTION (I) ADJUSTMENT PATTERN FOR PRINT POSITION DEVIATION BETWEEN FIRST SCAN DIRECTION AND SECOND SCAN DIRECTION (PRINTED BY FIRST HEAD)

(J) ADJUSTMENT PATTERN FOR PRINT POSITION DEVIATION BETWEEN FIRST CARRIAGE SPEED AND SECOND CARRIAGE SPEED (PRINTED BY FIRST HEAD IN FIRST SCAN DIRECTION)

FIG.10

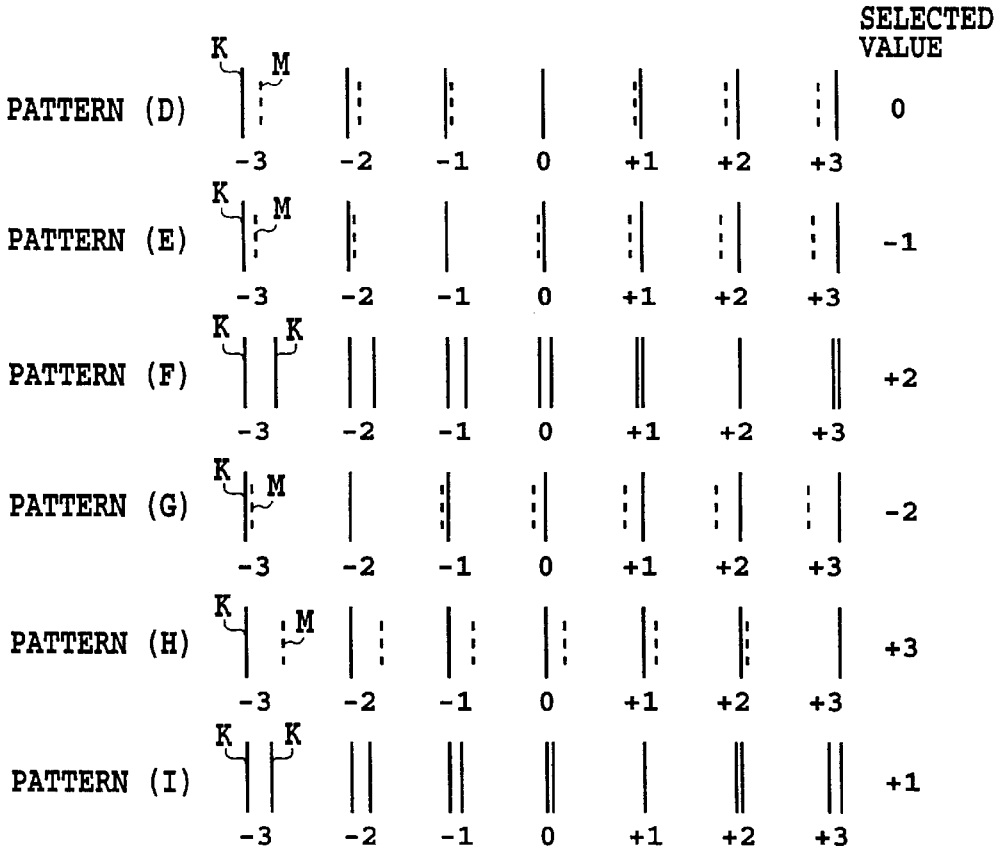

FIRST CARRIAGE SPEED (D) ADJUSTMENT PATTERN FOR PRINT POSITION DEVIATION BETWEEN FIRST AND SECOND HEADS IN FIRST SCAN DIRECTION (E) ADJUSTMENT PATTERN FOR PRINT POSITION DEVIATION BETWEEN FIRST AND SECOND HEADS IN SECOND SCAN DIRECTION (F) ADJUSTMENT PATTERN FOR PRINT POSITION DEVIATION BETWEEN FIRST SCAN DIRECTION AND SECOND SCAN DIRECTION

SECOND CARRIAGE SPEED (G) ADJUSTMENT PATTERN FOR PRINT POSITION DEVIATION BETWEEN FIRST AND SECOND HEADS IN FIRST SCAN DIRECTION (H) ADJUSTMENT PATTERN FOR PRINT POSITION DEVIATION BETWEEN FIRST AND SECOND HEADS IN SECOND SCAN DIRECTION (I) ADJUSTMENT PATTERN FOR PRINT POSITION DEVIATION BETWEEN FIRST SCAN DIRECTION AND SECOND SCAN DIRECTION

FIG.11

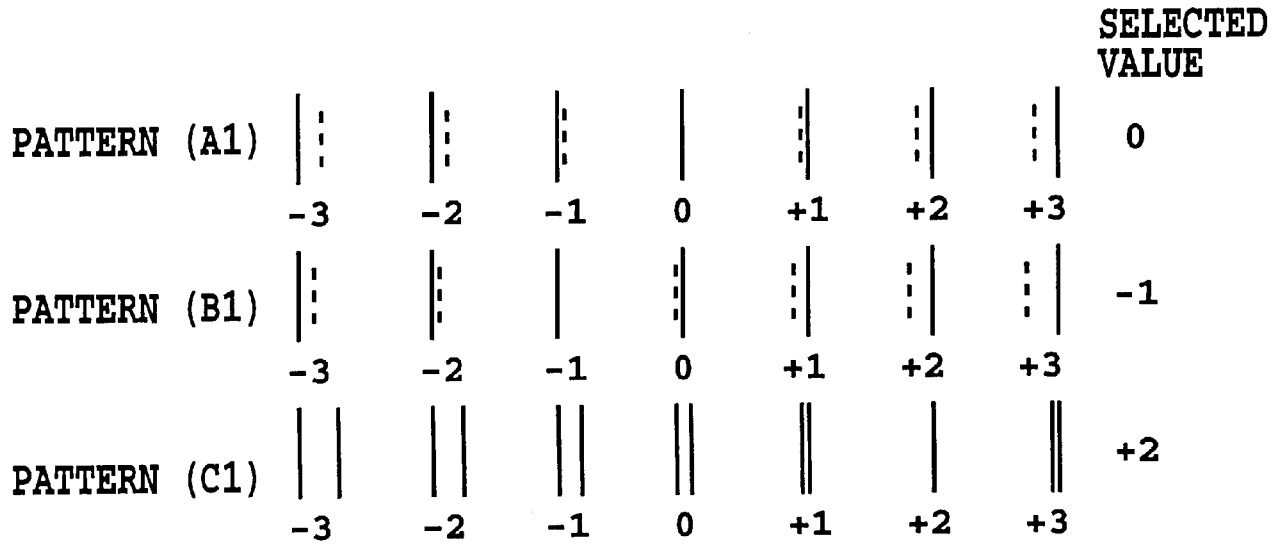

FIRST CARRIAGE SPEED (A1) ADJUSTMENT PATTERN FOR PRINT POSITION DEVIATION BETWEEN FIRST AND SECOND HEADS IN FIRST SCAN DIRECTION (B1) ADJUSTMENT PATTERN FOR PRINT POSITION DEVIATION BETWEEN FIRST AND SECOND HEADS IN SECOND SCAN DIRECTION (C1) ADJUSTMENT PATTERN FOR PRINT POSITION DEVIATION BETWEEN FIRST SCAN DIRECTION AND SECOND SCAN DIRECTION (PRINTED BY FIRST HEAD)

FIG.12A

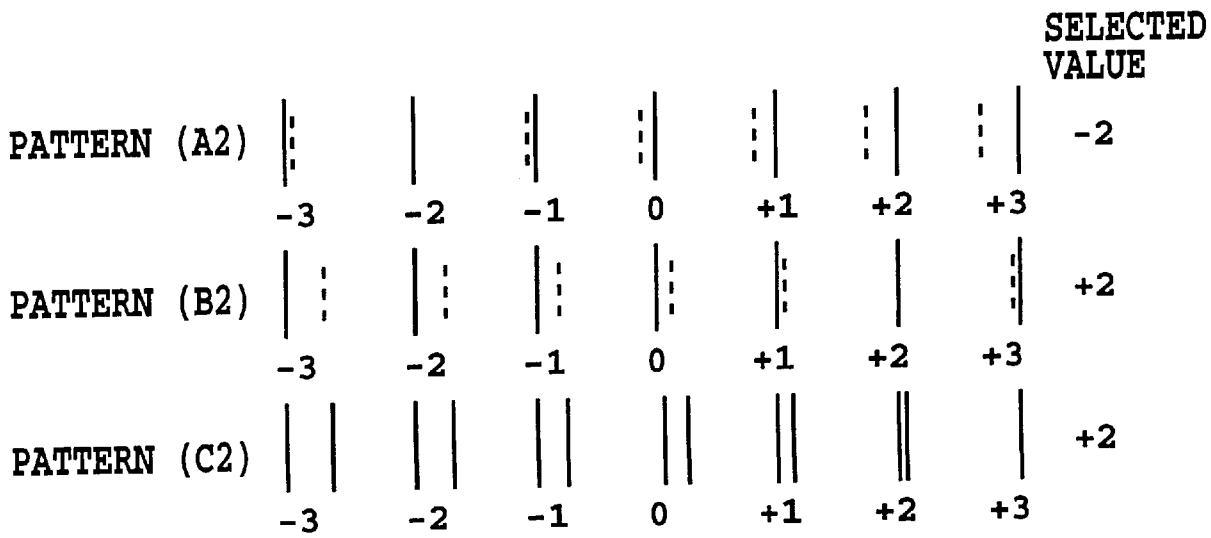

SECOND CARRIAGE SPEED (A2) ADJUSTMENT PATTERN FOR PRINT POSITION DEVIATION BETWEEN FIRST AND SECOND HEADS IN FIRST SCAN DIRECTION (B2) ADJUSTMENT PATTERN FOR PRINT POSITION DEVIATION BETWEEN FIRST AND SECOND HEADS IN SECOND SCAN DIRECTION (C2) ADJUSTMENT PATTERN FOR PRINT POSITION DEVIATION BETWEEN FIRST SCAN DIRECTION AND SECOND SCAN DIRECTION (PRINTED BY FIRST HEAD)

FIG.12B

| FIG.13A |
| --- |
| FIG.13B |

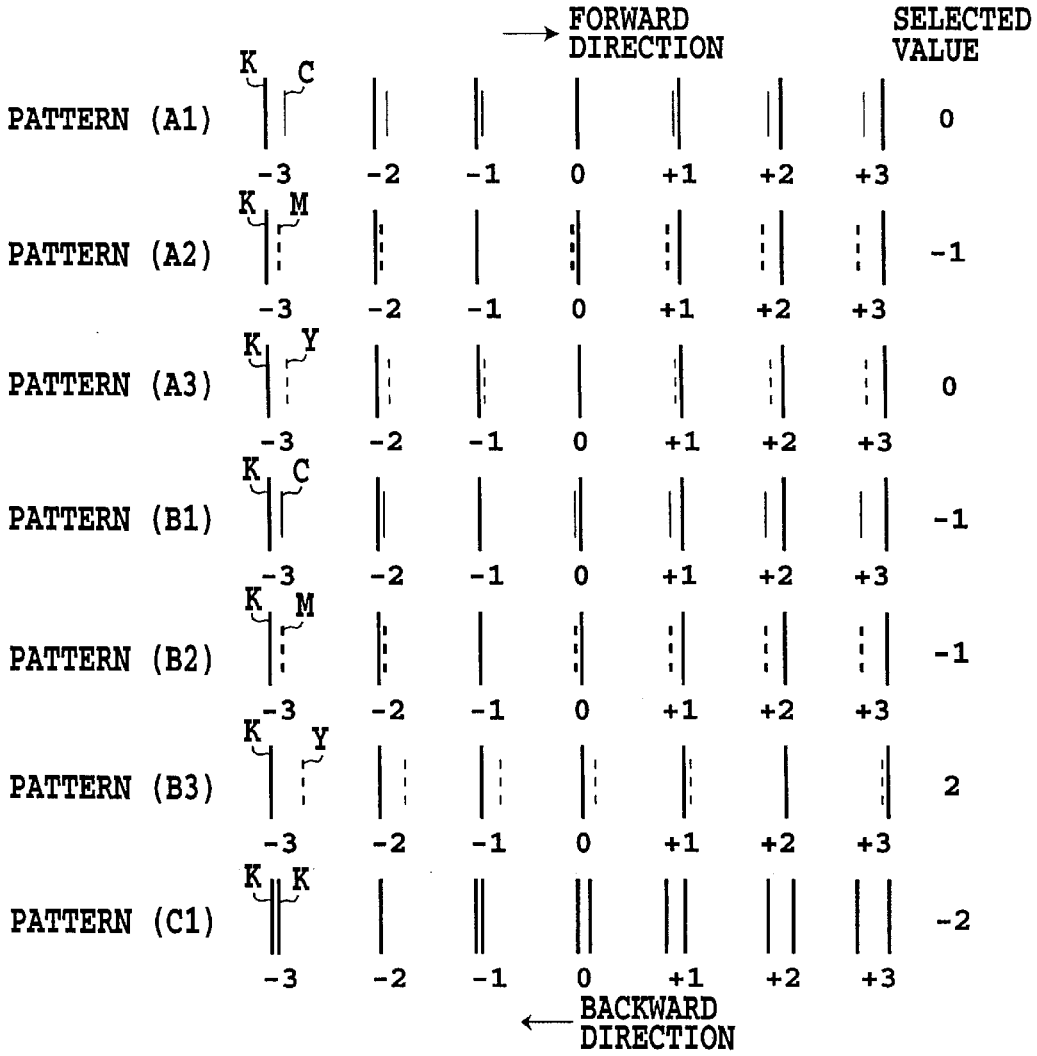

(A1) ADJUSTMENT PATTERN FOR PRINT POSITION DEVIATION BETWEEN FIRST AND SECOND HEADS IN FIRST SCAN DIRECTION (A2) ADJUSTMENT PATTERN FOR PRINT POSITION DEVIATION BETWEEN FIRST AND THIRD HEADS IN FIRST SCAN DIRECTION (A3) ADJUSTMENT PATTERN FOR PRINT POSITION DEVIATION BETWEEN FIRST AND FOURTH HEADS IN FIRST SCAN DIRECTION (B1) ADJUSTMENT PATTERN FOR PRINT POSITION DEVIATION BETWEEN FIRST AND SECOND HEADS IN SECOND SCAN DIRECTION (B2) ADJUSTMENT PATTERN FOR PRINT POSITION DEVIATION BETWEEN FIRST AND THIRD HEADS IN SECOND SCAN DIRECTION (B3) ADJUSTMENT PATTERN FOR PRINT POSITION DEVIATION BETWEEN FIRST AND FOURTH HEADS IN SECOND SCAN DIRECTION (C1) ADJUSTMENT PATTERN FOR PRINT POSITION DEVIATION BETWEEN FIRST SCAN DIRECTION AND SECOND DIRECTION

FIG.15

PRINTING APPARATUS AND METHOD FOR CORRECTING PRINT POSITIONS

This application is based on patent application Ser. No. 10-302806 filed on Oct. 23, 1998 in Japan, the content of which is incorporated hereinto by reference.

BACKGROUND OF THE INVENTION

1. Field of the Invention

The present invention relates to a printing apparatus and a method for correcting print positions and more specifically to a method for registering print positions when a plurality of print heads print in both forward and backward scans.

2. Description of the Prior Art

An ink jet printing method, because of its advantages such as a low noise, a low running cost and ease with which to reduce an apparatus size and produce color images, has found a wide range of applications as in printers and copying machines. Such an ink jet printing method ejects ink droplets from nozzles to form ink dots on printing paper thereby producing an image. In producing a color image, a plurality of print heads are used and the printing is often performed in both directions of scan (hereinafter also referred to simply as a "bidirectional printing") to enhance a printing speed.

In the bidirectional printing using the plurality of print heads, registration of print positions is relatively important for improving an image quality. In this case, the print position registration is performed for following positional deviations with respect to the scan direction of the print heads. It should be noted that there are two types of bidirectional printing: one performs a plurality of scans over the same area to complete an image and the other performs a single scan over any particular area to complete the printing and feeds paper between the forward scan and the backward scan. This specification assumes mainly the former type of the "bidirectional printing" in the following descriptions but also includes the latter type. In the latter case, the print position deviation becomes critical at a boundary between scanned areas.

1) Print position deviation between forward and backward printing.

2) Print position deviation among a plurality of print heads arranged in a scan direction.

In an apparatus other than the above-mentioned serial type printing apparatus, such as a full line type printing apparatus in which the printing paper is fed with respect to the print heads, the print position registration is performed to eliminate print position deviations among the print heads in the paper feed direction.

A reason for which the print position registration stated above is required is as follows. As for the positional deviation between the forward and backward printing, it is caused by mechanical factors such as backlash. As for the positional deviation among the print heads, particularly when a plurality of replaceable print heads are used, it is caused by variations of tolerance between the print-heads and the carriage holding them.

In the case of the print position registration between the forward and backward scans in the bidirectional printing for example, a practice to deal with the problems described above involves adjusting a print timing during respective forward and backward scans to change relative print position conditions for the forward and backward scans in a plurality of stages and performing forward and backward scans under these adjusted conditions to print on the printing medium an adjustment pattern consisting of a plurality of lines or the like. On the other hand, in the case of the position registration among the plurality of print heads, it is a practice to change the relative print position conditions of each head as the carriage is scanned in a particular direction and similarly print an adjustment pattern consisting of a plurality of lines with each head. The user visually checks these printed patterns, selects the print position condition under which the positions of the printed lines are best aligned, and sets data on the print position condition in a printing apparatus or host computer, thereby correcting the print positions.

The print position correction based on the conventional method described above, however, may pose the following problem when the bidirectional printing is done using a plurality of print heads.

Print positions may deviate due to varying factors, including variations in an ejection angle and a speed of ink droplets ejected from the print head, variations in parallelism between the printing medium and the print head or the carriage holding the print head, and variations in a distance between the print head and the printing medium (also referred to as "paper gap"). To deal with this problem, a conventional method corrects the printing positions as described above and strictly controls manufacturing errors of print heads and a precision of the carriage drive mechanism to minimize the occurrence of the print position deviations per se. This, however, has led to an increase in the cost of the printer and consumables.

The reason that the conventional print position correction method requires an increased precision as described above, in the case of bidirectional printing using a plurality of print heads, will be explained by referring to FIGS. 1A to 1D.

In FIGS. 1A to 1D, a reference numeral 200 denotes a carriage, 201 and 202 print heads, 203 a printing medium such as paper, and 2101–2104 ink dots respectively formed on the printing medium with an ink droplet ejected from the print heads.

FIGS. 1A and 1B represent a relation between the print heads and the printed dots in the case that printing is performed while scanning the print head from left to right in the figure (the scan direction in this case will be taken as a "forward direction"). FIGS. 1C and 1D represent the head-and-dot relation in the case that printing is performed while scanning the print head from right to left (the scan direction in this case will be taken as a "backward direction"). Reference signs in the figure are as follows.

X: a physical distance between the nozzle sections of the heads 201 and 202

$V_{CR}$: a moving speed of the carriage h: a nozzle-to-paper distance or the paper gap $V_1$: a speed of the ink droplet ejected from the head 201

$V_2$: a speed of the ink droplet ejected from the head 202

$\theta_1$: an ejection angle of the ink droplet ejected from the head 201 with respect to a direction normal to a plane of the paper $\theta_2$: an ejection angle of the ink droplet ejected from the head 202 with respect to the direction normal to the plane of paper Here, the ejected ink droplet speeds $V_1$, $V_2$ and angles $\theta_1$, $\theta_2$ are those when the carriage is at rest. Actual ejection speeds and angles are obtained by combining respective components of the carriage moving speed $V_{cr}$ with the respective speeds $V_1$, $V_2$ and angles $\theta_1$, $\theta_2$. For the sake of simplicity, such representations are omitted in the figure.

In FIG. 1A, the ink droplet ejected when the head 201 reaches a position above the position A on the printing medium during the forward scan forms a dot 2101. Similarly, in FIG. 1B, the ink droplet ejected when the head 202 reaches the position A during the forward scan forms a dot 2102. These dots land on the paper, deviated by ΔXf in the case that the ejection speeds $V_1$, $V_2$ and ejection angles $\theta_1$, $\theta_2$, characteristics of the heads, vary among the heads.

Similarly, in FIG. 1C, the ink droplet ejected when the head 202 is at the position A during the backward scan forms a dot 2103. Similarly, in FIG. 1D, the ink droplet ejected when the head 201 is at the position A during the backward scan form a dot 2104. In this case, also, these dots land deviated by ΔXb in the case that the head characteristics differ between the heads.

Amounts of ΔXf and ΔXb are affected not only by the print head characteristics $V_1$, $V_2$, $\theta_1$, $\theta_2$ but also by the paper gap h and the carriage speed $V_{CR}$. The parallelism between the carriage and the printing medium, also, is in effect reflected on $\theta_1$, $\theta_2$, influencing the ΔXf and ΔXb. Because of these influencing factors, the values of ΔXf and ΔXb differ in most cases and a fixed relationship between these values do not necessarily hold.

As to the print position deviation between the forward and backward printing, the conventional method to deal with such a deviation involves detecting, based on the adjustment pattern described above, a deviation between the dot 2101 formed during the forward scan of one of the two heads, for example a head 201, and the dot 2104 formed during the backward scan of the head, then, correcting the detected deviation or, alternatively, correcting this deviation plus deviations of the head from a predetermined reference position during the forward and backward scans (or a deviation from an ideal value considering these two kinds of deviations). On the other hand, as for the print position deviation between the print heads, the conventional method limits the direction of printing to, for example, only the forward direction, similarly detects the deviation ΔXf between the dot 2101 formed by the head 201 and the dot 2102 formed by the head 202, and then corrects this deviation. In this case, a deviation between the dot 2103 and the dot 2104 formed by the two heads during the backward scan, ΔXb, is corrected either by the same amount that was used to correct the above ΔXf or by a value estimated from the ΔXf. Hence, if the print position deviation between the two print heads during the forward scan, ΔXf, and the print position deviation during the backward scan, ΔXb, differ due to various factors described above, the correction for aligning the print positions cannot be performed appropriately, leaving the print positions deviated during the succeeding printing operations.

FIG. 2 is a schematic diagram showing an example of vertical lines printed after the above-described conventional print position correction was made. As described above, only the line corresponding to the dot 2103 formed during the backward printing is printed deviated by (ΔXf−ΔXb) from the line corresponding to the dot 2104. To prevent this deviation, the conventional method is required to minimize the aforementioned various factors associated with the deviation, which in turn leads to cost increases of the apparatus. Further, when the number of print heads increases, the control of the heads becomes more important.

SUMMARY OF THE INVENTION

An object of the present invention is to provide a printing apparatus and a print position correction method capable of minimizing print position deviations, which occur during bidirectional printing using a plurality of print heads, without having to maintain the precision of the printing apparatus at so high a level.

In a first aspect of the present invention, there is provided a printing apparatus which uses a plurality of print heads and reciprocally scans the plurality of print heads at least at one kind of speed mode to perform printing, and for which correcting print positions of the plurality of print heads is performed, the apparatus comprising:

adjustment pattern printing means for printing at least (2NM−1) kinds of print position deviation adjustment patterns, which are printed with a different combination of the print head or a scan direction of the print head or a scan speed of the print head, the respective different combination being used for printing, where M (≧1) is a number of scan speeds of the print head subjected to correcting the print positions and N (≧2) is a number of print heads;

calculating means for calculating a correction value for the print positions of the plurality of print heads based on inputs according to the at least (2NM−1) kinds of print position deviation adjustment patterns printed by the adjustment pattern printing means; and correcting means for correcting the print positions of the plurality of print heads based on the correction value calculated by the calculating means.

In a second aspect of the present invention, there is provided a printing apparatus which uses a plurality of print heads and scans the plurality of print heads at a plurality of kinds of speed mode to perform printing, and for which correcting print positions of the plurality of print heads is performed, the apparatus comprising:

first adjustment pattern printing means for printing at least (N−1) kinds of print position deviation adjustment patterns at one of a plurality of kinds of scan speeds subjected to correcting the print positions, where N (≧2) is a number of a plurality of print heads;

second adjustment pattern printing means for printing at least (N−1) kinds of print position deviation adjustment patterns at the other of the plurality of kinds of scan speeds after the print positions of the plurality of print heads have been corrected based on inputs according to the at least (N−1) kinds of print position deviation adjustment patters printed by the first adjustment pattern printing means;

calculating means for calculating a correction value for the print positions of the plurality of print heads based on inputs according to the at least (N−1) kinds of print position deviation adjustment patterns printed by the second adjustment pattern printing means; and correcting means for correcting the print position of the plurality of heads based on the correction value calculated by the calculating means.

In a third aspect of the present invention, there is provided a print position correcting method for a printing apparatus which uses a plurality of print heads and reciprocally scans the plurality of print heads at least at one kind of speed mode to perform printing, and for which correcting print positions of the plurality of print heads is performed, the method comprising the steps of:

printing at least (2NM−1) kinds of print position deviation adjustment patterns, which are printed with a different combination of the print head or a scan direction of the print head or a scan speed of the print head, the respective different combination being used for printing, where M (≧1) is a number of scan speeds of the print head-subjected to correcting the print positions and N (≧2) is a number of print heads;

calculating a correction value for the print positions of the plurality of print heads based on inputs according to the at least (2NM−1) kinds of print position deviation adjustment patterns printed in the adjustment pattern printing step; and correcting the print positions of the plurality of print heads based on the correction value calculated in the calculating step.

In a fourth aspect of the present invention, there is provided a print position correcting method for a printing apparatus which uses a plurality of print heads and scans the plurality of print heads at a plurality of kinds of speed mode to perform printing, and for which correcting print positions of the plurality of print heads is performed, the method comprising the steps of:

printing at least (N−1) kinds of first print position deviation adjustment patterns at one of a plurality of kinds of scan speeds subjected to correcting the print positions, where N (≧2) is a number of a plurality of print heads;

printing at least (N−1) kinds of second print position deviation adjustment patterns at the other of the plurality of kinds of scan speeds after the print positions of the plurality of print heads have been corrected based on inputs according to the at least (N−1) kinds of first print position deviation adjustment patters printed in the step for printing first adjustment pattern;

calculating a correction value for the print positions of the plurality of print heads based on inputs according to the at least (N−1) kinds of second print position deviation adjustment patterns printed in the step for printing second adjustment pattern; and correcting the print position of the plurality of heads based on the correction value calculated in the calculating step.

In a fifth aspect of the present invention, there is provided a computer program element of a print position correcting processing for a printing apparatus which uses a plurality of print heads and reciprocally scans the plurality of print heads at least at one kind of speed mode to perform printing, and for which correcting print positions of the plurality of print heads is performed, the program element comprising:

computer program code means to make the computer execute to print at least (2NM−1) kinds of print position deviation adjustment patterns, which are printed with a different combination of the print head or a scan direction of the print head or a scan speed of the print head, the respective different combination being used for printing, where M (≧1) is a number of scan speeds of the print head subjected to correcting the print positions and N (≧2) is a number of print heads;

to calculate a correction value for the print positions of the plurality of print heads based on inputs according to the at least (2NM−1) kinds of print position deviation adjustment patterns printed in the adjustment pattern printing process; and to correct the print positions of the plurality of print heads based on the correction value calculated in the calculating process.

In a sixth aspect of the present invention, there is provided a computer program element of a print position correcting processing for a printing apparatus which uses a plurality of print heads and scans the plurality of print heads at a plurality of kinds of speed mode to perform printing, and for which correcting print positions of the plurality of print heads is performed, the program element comprising:

computer program code means to make the computer execute to print at least (N−1) kinds of first print position deviation adjustment patterns at one of a plurality of kinds of scan speeds subjected to correcting the print positions, where N (≧2) is a number of a plurality of print heads;

to print at least (N−1) kinds of second print position deviation adjustment patterns at the other of the plurality of kinds of scan speeds after the print positions of the plurality of print heads have been corrected based on inputs according to the at least (N−1) kinds of first print position deviation adjustment patters printed in the process for printing first adjustment pattern;

to calculate a correction value for the print positions of the plurality of print heads based on inputs according to the at least (N−1) kinds of second print position deviation adjustment patterns printed in the process for printing second adjustment pattern; and to correct the print position of the plurality of heads based on the correction value calculated in the calculating process.

With the above configuration, at least (2NM−1) kinds of print position deviation adjustment patterns, each with a different combination of print head, scan direction or a scan speed, are printed. These adjustment patterns can be used, for example, as the adjustment patterns for the print position deviation between a plurality of print heads in each of the forward and backward scan directions. Based on these patterns, it is possible to correct the position deviation between a plurality of print heads in each scan direction. These patterns can also be used as the adjustment patterns for print position deviation of one of the print heads between the forward scan and the backward scan. Based on the latter patterns, it is possible to correct the position deviation of one print head between the forward scan and backward scan. These patterns allow adjustment of the print position deviation between a plurality of print heads and also of the print position deviation for each print head between the forward scan and the backward scan.

The above and the other objects, effects, features and advantages of the present invention will become more apparent from the following description of embodiments thereof taken in conjunction with the accompanying drawings.

BRIEF DESCRIPTION OF THE DRAWINGS

FIG. 10 is a diagram showing print position correction (adjust) patterns according to a second embodiment of the present invention;

FIG. 11 is a diagram showing another example of print position correction patterns according to the second embodiment of the present invention;

FIGS. 12A and 12B are diagrams showing print position correction (adjust) patterns according to a third embodiment of the present invention;

FIG. 15 is a diagram showing print position correction (adjust) patterns according to the fourth embodiment of the present invention;

DESCRIPTION OF THE PREFERRED EMBODIMENTS

Now, embodiments of the present invention will be described in detail with reference to the accompanying drawings.

FIRST EMBODIMENT

Figure 3:
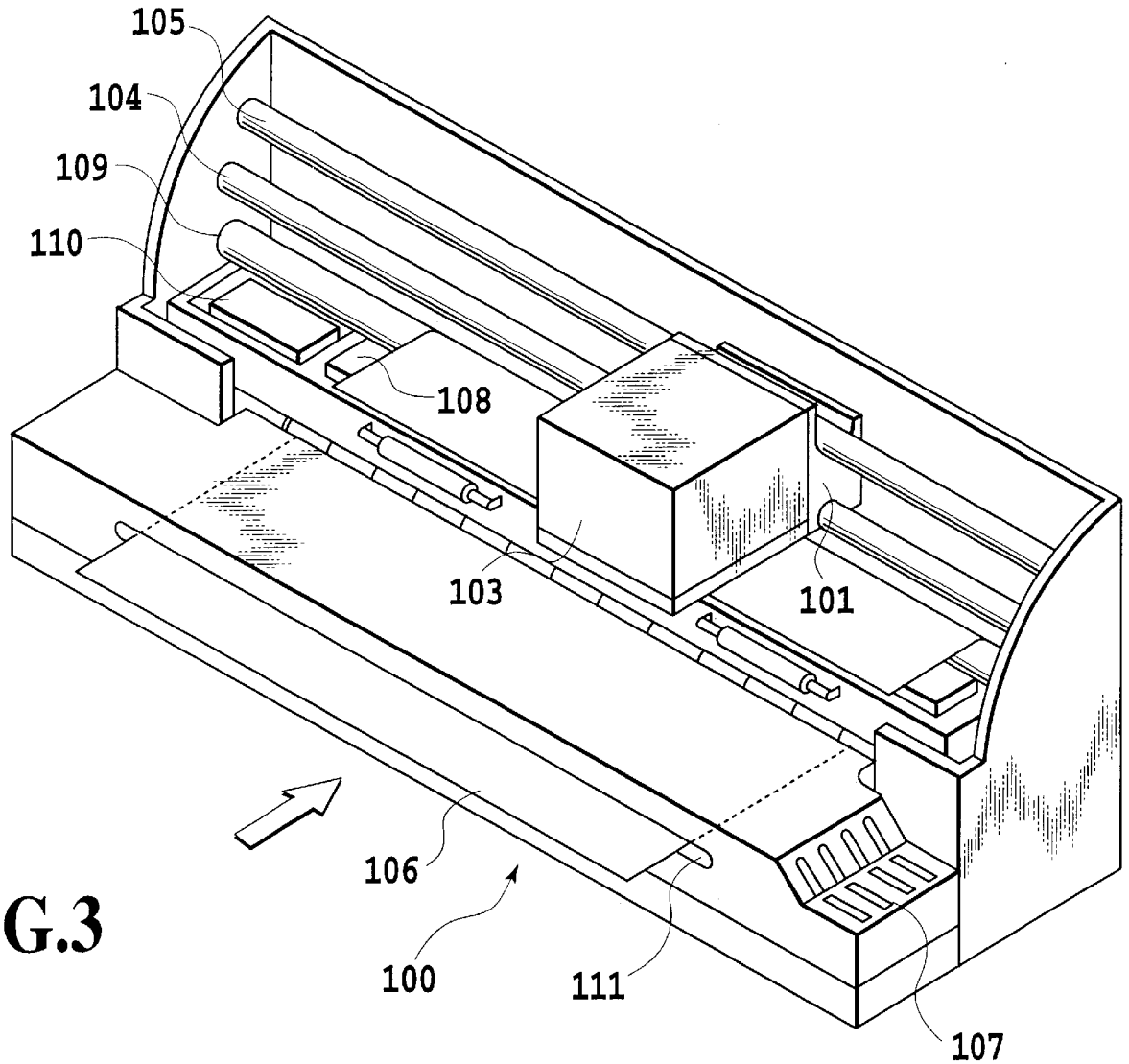
FIG. 3 is a perspective view showing an outline configuration of an ink jet printer according to one embodiment of the present invention

FIG. 3 is a perspective view showing one embodiment of an ink jet-printing apparatus to which the present invention is applied.

A printing medium 106 inserted into a printing apparatus 100 at a paper feed position is transferred by a feed roller 109 to a print area of a print head unit 103. Under the printing medium in the print area is provided a platen 108. A carriage 101 slidably engages two guide shafts, a guide shaft a 104 and a guide shaft b 105, and is slidable along these guide shafts so that the print heads can be reciprocally scanned over the print area. The carriage 101 mounts a print head unit 103 including print heads for ejecting a plurality of color inks and ink tanks for supplying inks to the associated print heads. The plurality of color inks used in this example of the ink jet printing apparatus are four inks: black (Bk), cyan (C), magenta (M) and yellow (Y).

Below the left end of the region where the carriage can be moved is installed an ejection performance recovery unit 110 which is used to perform election performance recovery operations such as capping a nozzle section of the print heads while not printing. The left end is called a home position of the print heads. Denoted 107 are switch and display element sections. The switch section is used to turn on or off the power of printing apparatus and set a variety of print modes. The display section displays a various states of the printing apparatus.

Figure 4:
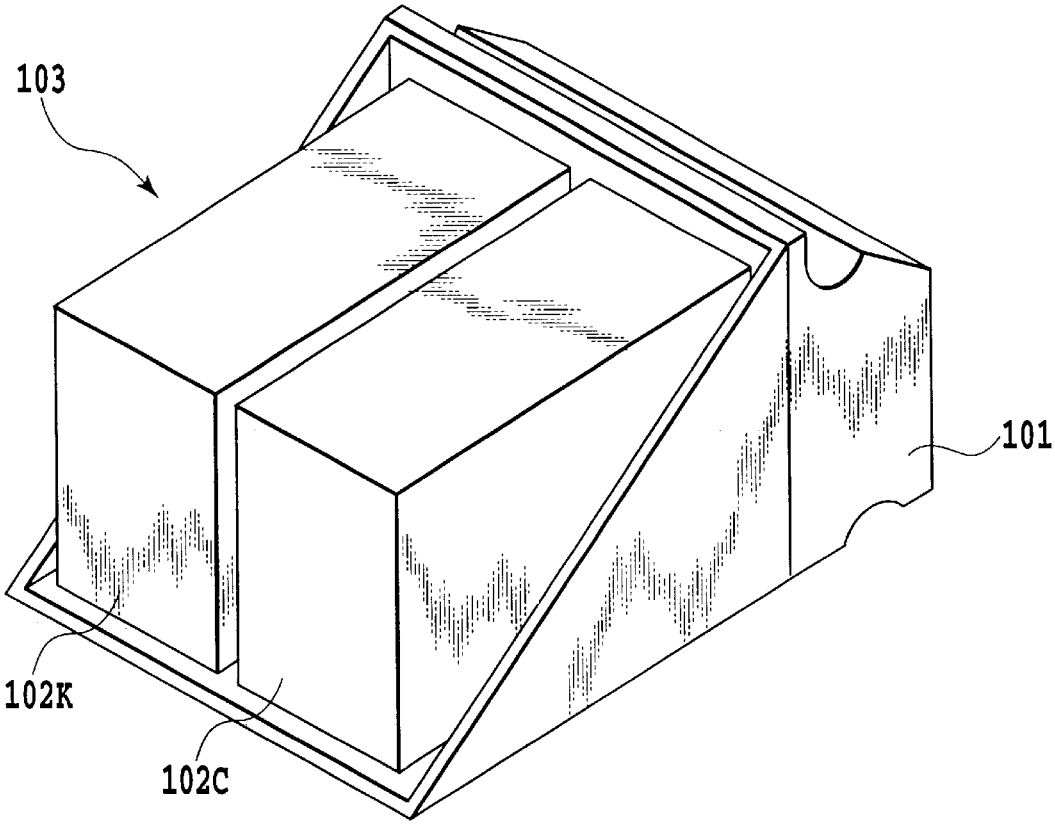
FIG. 4 is a perspective view showing a print head unit used in the printer of FIG. 3.

FIG. 4 is a perspective view showing the carriage 101 and the print head unit 103 mounted on the carriage.

In the figure, the print head unit 103 comprises a print head 102K and a print head 102C, each of which can be detachably mounted on the carriage. The print head 102K ejects a black ink and the print head 102C has an integral nozzle section for ejecting three color inks: cyan, magenta and yellow. Each of the print heads has its nozzle section and ink tank section arranged in an integral structure. The construction of the carriage 101 that can removably accommodate the print heads can use a known construction, and thus its detailed explanation is omitted here.

Figure 5:
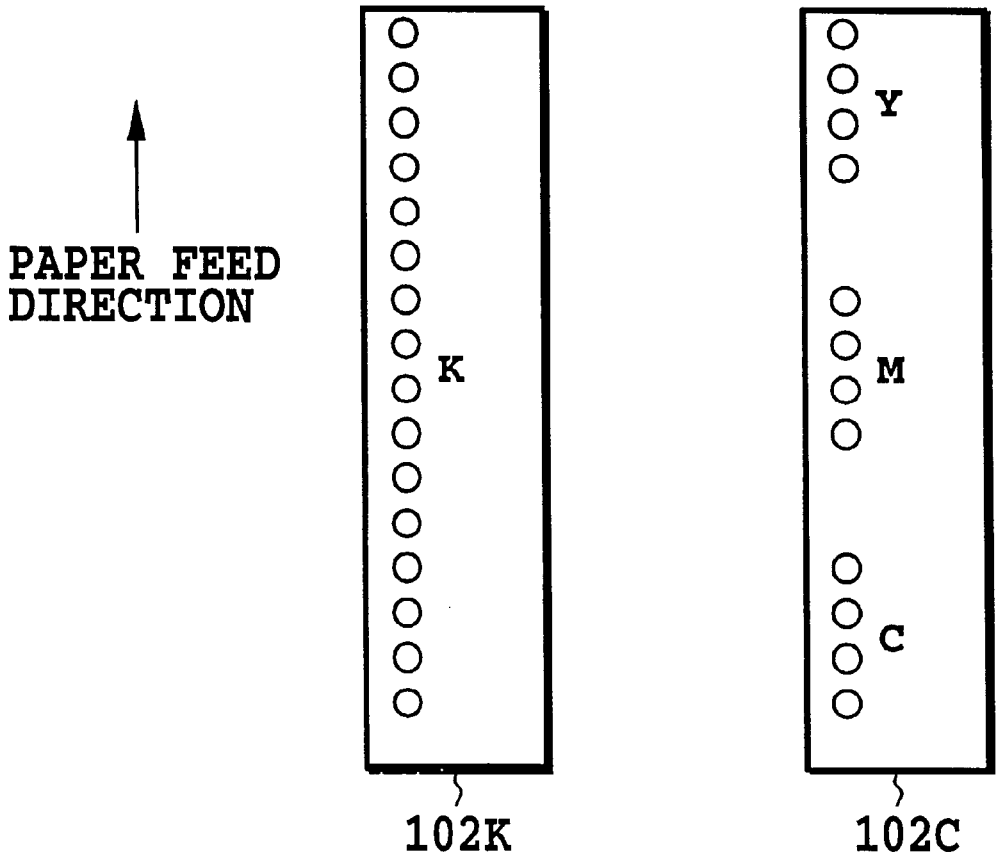
FIG. 5 is a schematic diagram showing nozzle sections of the print head unit.

FIG. 5 is a front view schematically showing nozzle sections of the respective print heads 102K and 102C. The print head 102K has a column of nozzles for ejecting a black ink and the print head 102C has arranged in the paper feed direction respective columns of nozzles for ejecting cyan, magenta and yellow inks.

Figure 6:
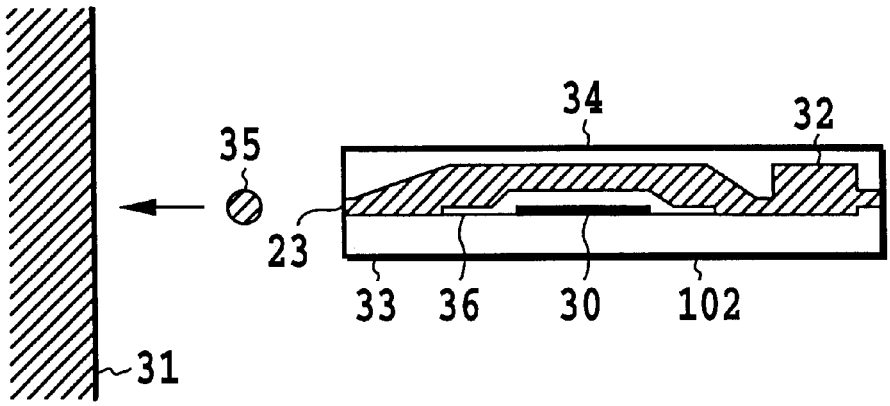
FIG. 6 is a cross section schematically showing an internal structure of the nozzle section of the print head unit.

FIG. 6 is a cross section schematically showing the structure of an ink passage corresponding to one nozzle of the print head. This example of the ink jet print head employs a printing system that incorporates an electrothermal transducer, a heating element 30, for each ink nozzle and applies a drive signal corresponding to print information to the heating element to eject ink from a nozzle 23. The heating element 30 is provided so that the element independently heats in each nozzle. Ink in the ink passage that is rapidly heated by the heating element 30 forms a bubble through film boiling and the pressure of the bubble is used to eject an ink droplet 35 toward a printing medium 31, as shown in FIG. 6, thus forming characters and images on the printing medium. At this case, the volume of an ejected ink droplet of each color is 15–80 pl. Each nozzle 23 is connected with an ink passage communicating at the rear end with a common liquid chamber 32 that supplies ink to the ink passages. In each of the ink passages connected to the corresponding nozzles there are provided the heating element 30—the electrothermal transducer that generates heat energy for ejecting the ink droplet from the nozzle—and electrode wires for supplying electricity to the heating element 30. The heating element 30 and electrode wires are formed on a substrate 23 made of, for example, silicon by a deposition technique. A protective film 36 is formed over the heating element 30 to prevent a direct contact between the heating element and the ink. Further, forming a partition wall 34 of resin or glass material as layers over this substrate forms the nozzles, ink passages and common liquid chamber.

The printing system using the heating element, which is the electrothermal transducer, is commonly called a bubble jet system because it utilizes a bubble formed by the application of heat energy for ejecting an ink droplet.

Figure 7:
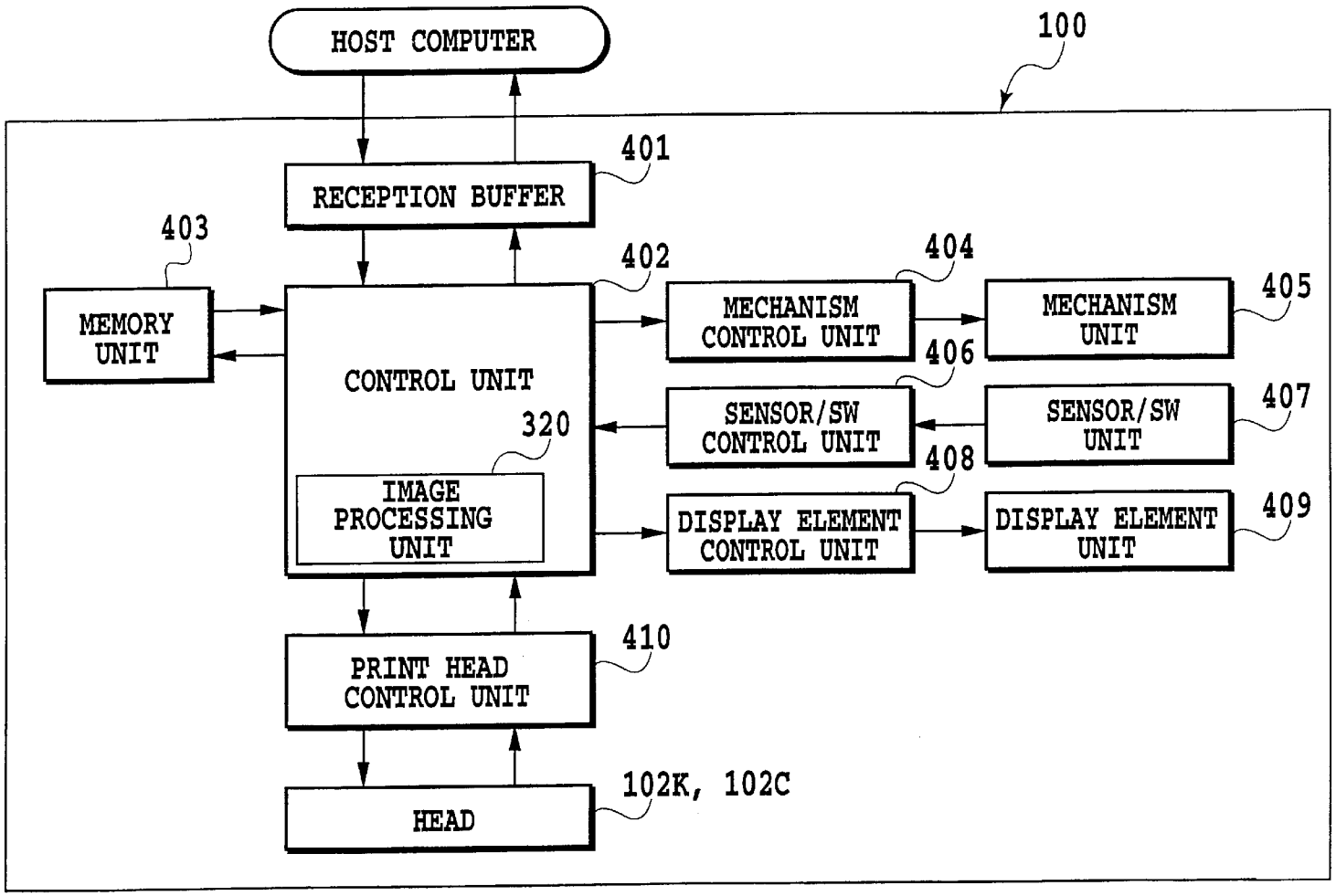
FIG. 7 is a block diagram showing a control configuration of the printer.

FIG. 7 is a block diagram showing mainly a control configuration of the above described ink jet printing apparatus of this embodiment. Data on characters and images to be printed (hereinafter referred to simply as "image data") is fed from a host computer to a reception buffer 401 of the printing apparatus. Data for confirming that the data is being transferred correctly from the host computer and data representing the operation state of the printing apparatus are returned from the printing apparatus to the host computer. Data in the reception buffer 401 is transferred, under the control of a control unit 402 having a CPU, to a memory unit 403 where it is stored temporarily in its RAM (random access memory). A mechanism control unit 404 controls the operation of a mechanism unit 405 including a carriage motor and a line feed motor under the command of the control unit 402. A sensor/switch control unit 406 sends signals from a sensor/switch unit 407 consisting of a variety of sensors and switches to the control unit 402. A display element control unit 408 controls under the command of the control unit 402 a display element unit 409 including LEDs and liquid crystal display elements on the display panels. A print head control unit 410 controls under the command of the control unit 402 the operations of the print heads 102K, 102C. It also transmits to the control unit 402 temperature information representing the states of the print heads 102K, 102C.

Now, a print position registration processing according to this embodiment with the above configuration will be explained.

Figure 8:
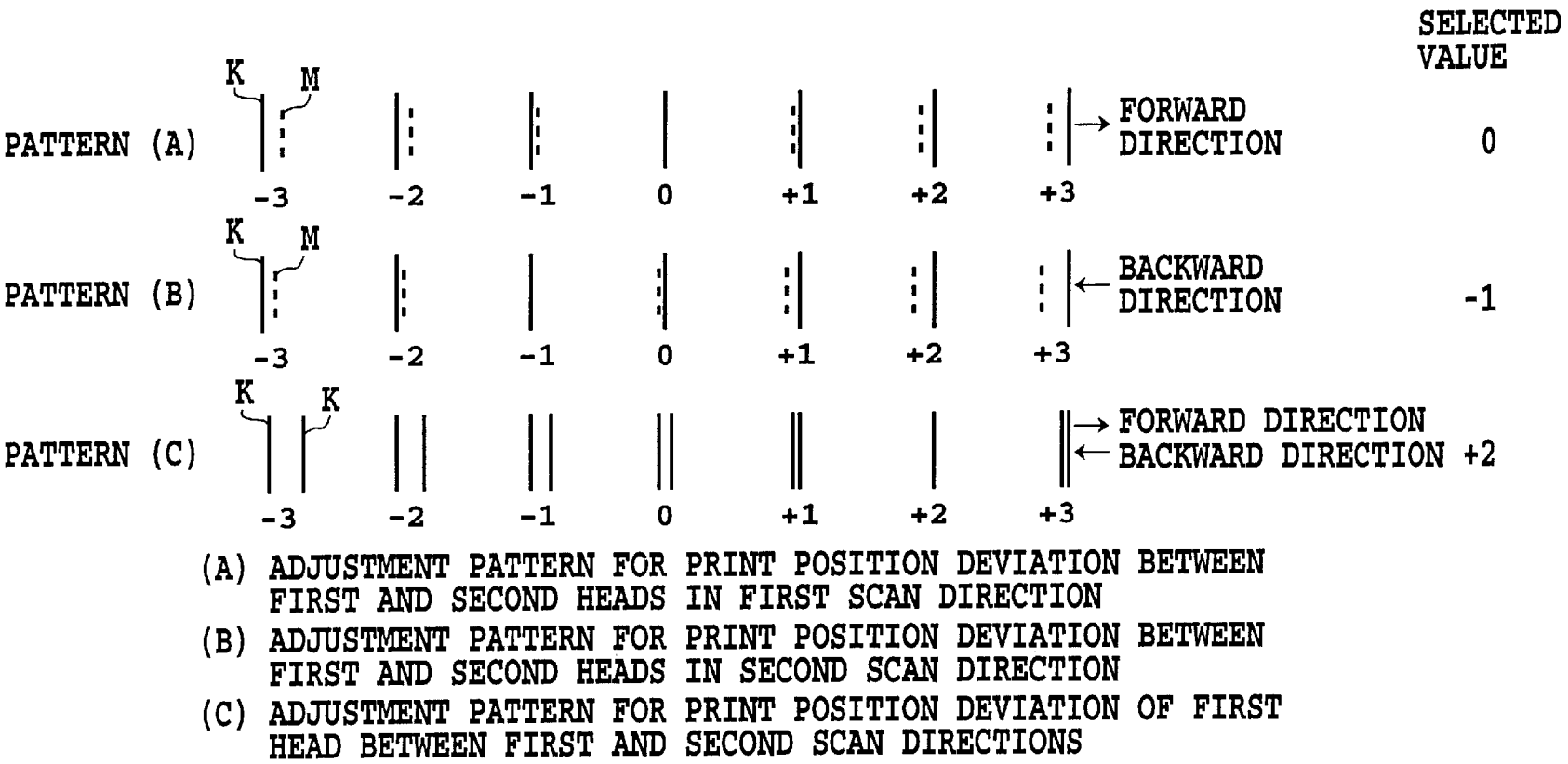
FIG. 8 is a diagram showing print position correction (adjust) patterns according to a first embodiment of the present invention.
Figure 9:
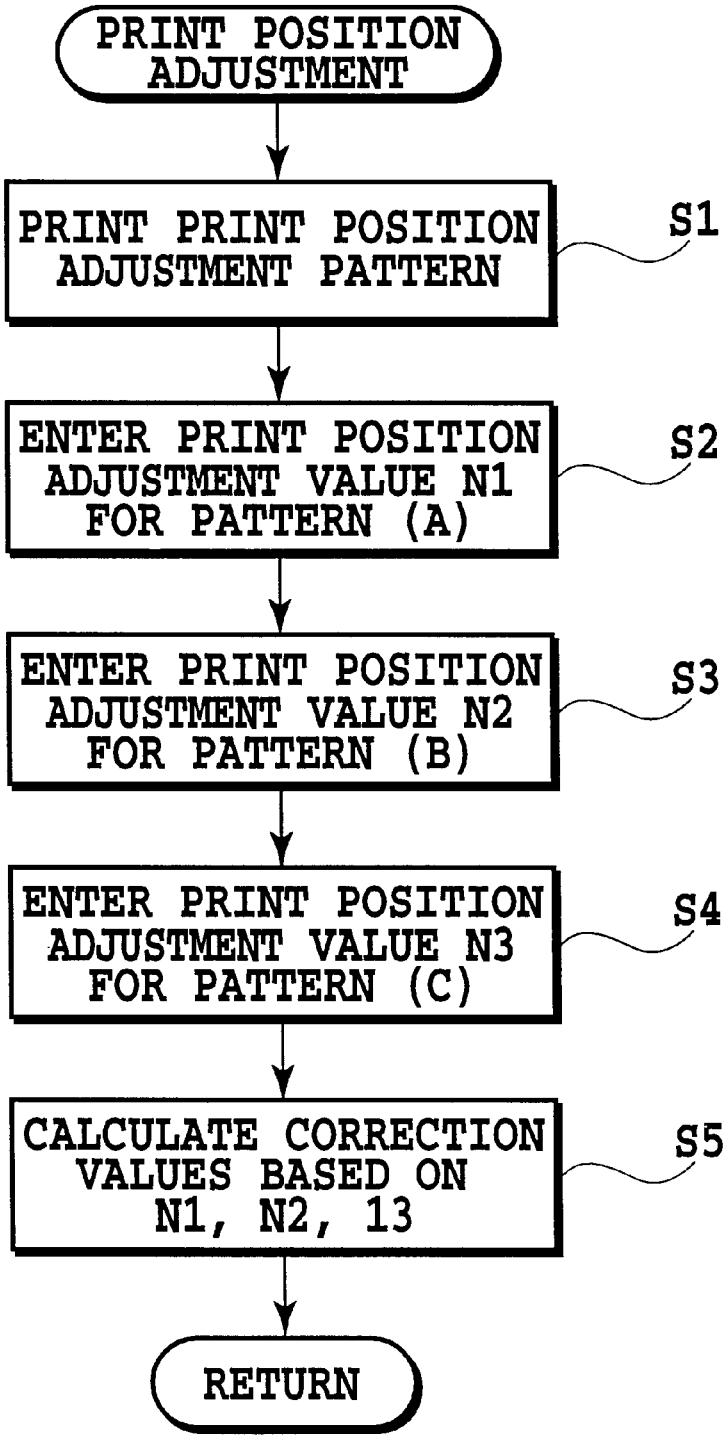
FIG. 9 is a flow chart showing a sequence of print position correction processing according to the first embodiment of the present invention.

FIG. 8 is a schematic diagram showing one example of a print position adjustment pattern used in the print position registration processing according to one embodiment of this invention. FIG. 9 is a flow chart showing a procedure of the print position registration processing of this embodiment.

This pattern consists of three kinds of patterns (A)–(C). The pattern (A) is one for correcting the print position deviation between the print head 102K and the print head 102C when these print heads perform the forward scan. Vertical lines in the pattern (A) are printed by means of all nozzles of respective heads. The pattern (A) is printed (at step S1 in FIG. 9) at a condition where the vertical lines of the magenta ink is printed by means of the print head 102C at respective timings which change in an offset range of −3 to +3, and the offset range is determined based on the timing (ejection timing) of printing the vertical line of the black ink by means of the print head 102K, as a reference. While in this embodiment the offset of print timing has a unit of one-pixel interval, the unit of offset is of course not limited to this amount and may be set otherwise depending on the configuration of the apparatus. By observing the printed result, a user of the ink jet printing apparatus selects an offset value for which the vertical lines of the respective inks overlap most closely, and enters it as an adjustment value N1(in this case, "0") into the host computer through its printer driver (step S2).

Similarly, the pattern (B) is used to correct the print position deviations between the print head 102K and the print head 102C when these print heads perform the backward scan. The pattern (B) is printed (at step S1) at a condition where the vertical lines of the magenta ink is printed by means of the print head 102C at respective timings which change in an offset range of −3 to +3, and the offset range is determined based on the timing (ejection timing) of printing the vertical line of the black ink by means of the print head 102K, as a reference. By observing the printed result, the user selects the offset value for which the vertical lines overlap most closely, and enters it as the adjustment value N2(in this case, "−1") into the host computer through the printer driver (step S3).

The pattern (C) is a print pattern formed only by means of the print head 102K and is used to correct the print position deviations between the forward and backward scans. With respect to the timing of printing the vertical lines during the forward scan of the print head taken as a reference, the timing of printing the vertical lines during the backward scan is changed in the offset range of −3 to +3(step S1). By observing the printed result, the user selects the offset value for which the vertical lines overlap most closely, and enters it as an adjustment value N3 (in this case, "+2") into the host computer through the printer driver (step S4).

The printing apparatus, based on the set values N1, N2, N3 entered into the host computer, performs calculations to obtain a correction value used for correcting the print positions of the respective print heads in respective printing directions. In the case of FIG. 1, N1=0, N2=−1, and N3=+2.

The configuration and processing for entering the above-described adjustment values into the host computer and for calculating the correction value (for example, an adjustment value for the ejection timing) based on the entered adjustment values are similar to those already known, and-thus their explanations are not given here. Further, while the calculation of the correction value is performed in the printing apparatus in the above described embodiment, the calculation may be performed by the printer driver (in the host computer) and the calculated result may be supplied to the printing apparatus.

Figure 1A:
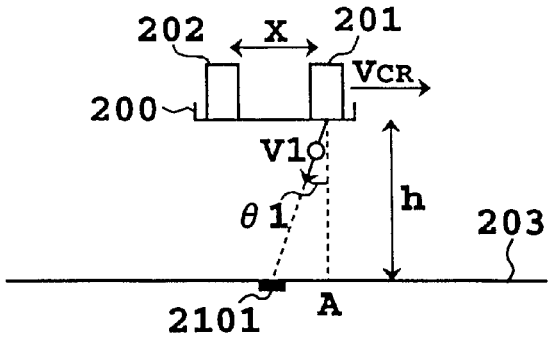
FIGS. 1A to 1D are diagrams showing print position deviations associated with a conventional print position correction.
Figure 1B:
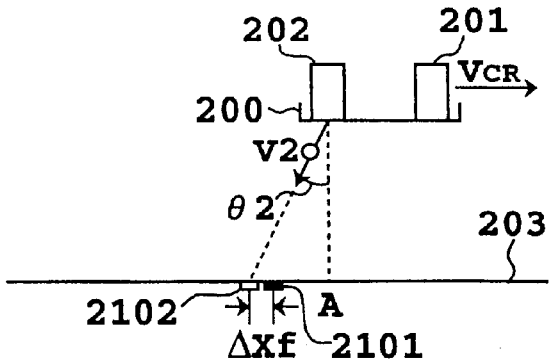
Figure 1C:
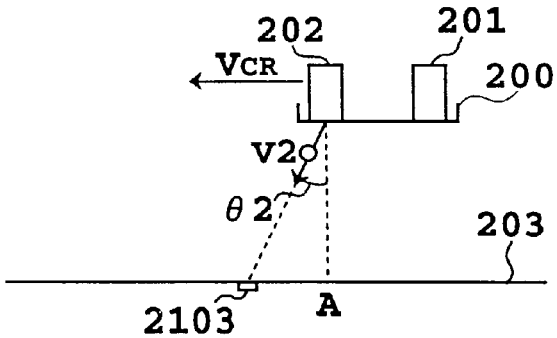
Figure 1D:
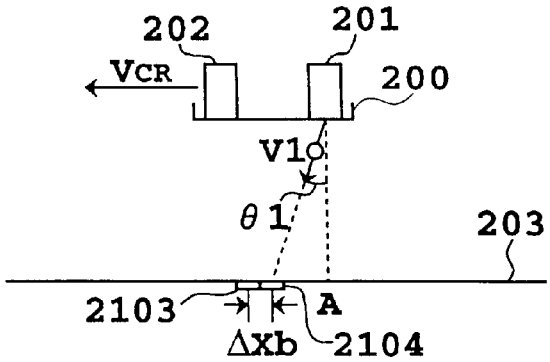
Figure 2:
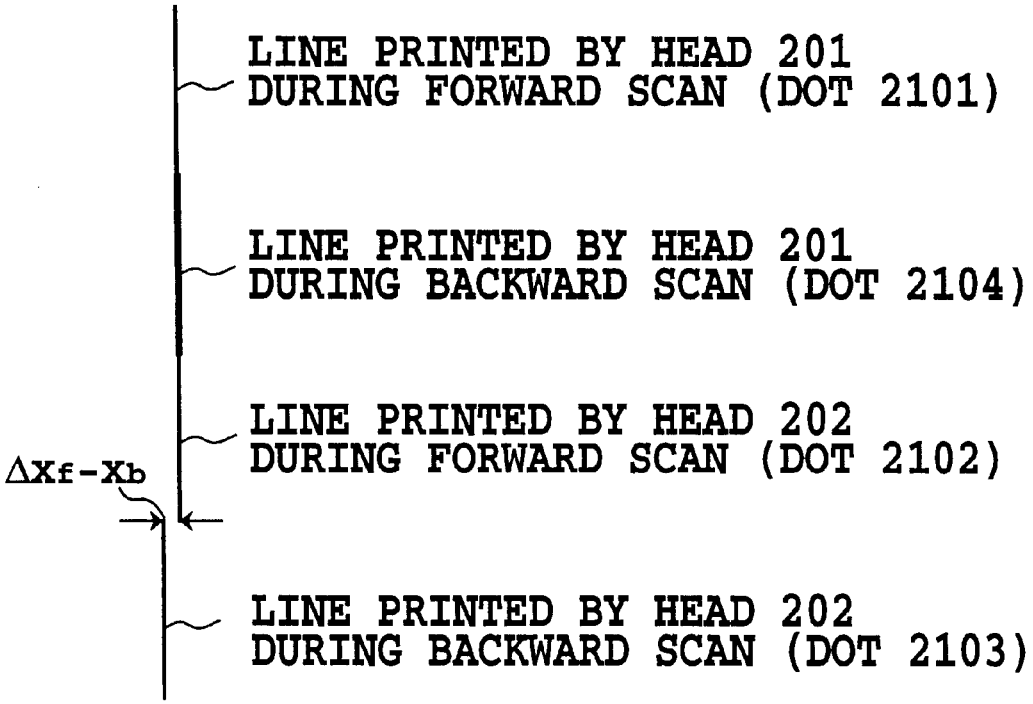
FIG. 2 is a diagram showing a print position deviation that cannot be eliminated with the conventional print position correction.

Next, advantages of this embodiment will be explained in comparison with the conventional method. In the conventional print position correction method, as already explained in FIGS. 1 and 2, when the print head not corrected with respect to scan directions (in the example of FIGS. 1 and 2, the head 202) prints in the different respective scan directions, the printed dots deviate by (ΔXf−ΔXb). To minimize print position deviations including the above-stated deviation between opposite scan directions, an effort has been made to improve the precision in the manufacturing process of the printing apparatus. With this embodiment, on the other hand, the deviation ΔXf between dots 2101 and dot 2102 of the dots 2101–2104 shown in FIGS. 1A–1D can be corrected by using the pattern (A) shown in FIG. 8. Further, the deviation ΔXb between the dots 2103 and 2104 can be corrected by using the pattern (B) and the deviation between dots 2101 and 2104 by using the pattern (C). This processing automatically corrects dot deviations that are not represented by the combinations of the above-described patterns, and can achieves the print position alignment not dependent on the manufacturing precision, to allow cost reductions.

Although in this embodiment, selecting of the print patterns is made as the pattern (A) to (C) shown in FIG. 8, and the deviations between dot 2101 and dot 2102, between dot 2103 and dot 2104, and between dot 2101 and dot 2104 are corrected, it is possible, according to the present invention, to select other combinations of dots. It is easily understood that the similar effect can also be obtained as long as the three patterns selected can determine respective deviations, for example, between dot 2101 and three other dots 2102, 2103, 2104. That is, as long as the three patterns selected can provide all combinations of four printed dots shown in FIG. 2, the similar effect can be obtained.

It should be noted that the adjustment patterns are not limited to the vertical lines and that using any known print position adjustment patterns give no effect upon the subject matter of the present invention. Further, while the above explanation is performed in the case of the offset range of −3 to +3, of course, other offset ranges may also be used. Also, if the range of offset is widened, the number of printed patterns increases making them difficult to observe or distinguish. It is, however, possible to print only as many vertical lines as can easily be identified. If no matching pattern can be found in that offset range, the offset range may be changed and patterns printed again for further adjustment, as proposed by the known method.

While this embodiment has described the correction method in which the user observes the printed result and determines the most suitable lines, it is possible to employ known print position correction techniques, such as one which automatically performs corrections by using a mounting scanner/sensor on an apparatus body and one in which correction setting is done by a manufacturer at time of shipping.

SECOND EMBODIMENT

The second embodiment of the present invention concerns a case where the print position registration method explained in the first embodiment is applied to a correction method in the case that there are a plurality of print modes with different carriage speeds. For simplicity of explanation, an example case in which the carriage has two different speeds $V_{CR1}$ and $V_{CR2}$ is taken up.

FIG. 10 is a schematic diagram showing an example of print position adjustment patterns according to this embodiment. In this embodiment, seven patterns (D) to (J) are printed, of which three patterns (D) to (F) correspond to a print mode of the carriage speed of $V_{CR1}$ and three patterns (G) to (I) to a print mode of the carriage speed of $V_{CR2}$. The respective groups of patterns (D)–(F) and (G)–(I), with respect to their respective printing speeds, correspond to the patterns (A)–(C) shown in FIG. 8 that are explained in the first embodiment. On the other hand, the pattern (J) is formed of dots printed by means of a first print head in a first scan direction at different carriage speeds. That is, the pattern is formed by printing dots at the various second carriage speeds of $V_{CR2}$ which is obtained by adding predetermined offset values to the first carriage speed of $V_{CR1}$ at which the dots are already printed.

As in the first embodiment, the user, after checking the printed result, enters the adjustment values N4–N10 for the patterns (D)–(J) into the host computer. Based on the entered set values N4–N10, the printing apparatus performs calculations to correct the print timing for each print head in each printing direction.

This embodiment has four more patterns than the first embodiment for the following reasons. As explained earlier, there are various factors for print position deviations and the amount of deviation changes as the carriage speed changes. That is, the speed component in the scan direction of an ink droplet ejected from the head changes with a change in the carriage speed and, because there are different carriage speeds, an amount of a play of the carriage at a ramp-up and a ramp-down of the carriage. This embodiment therefore corrects the print position deviations by taking the carriage speed into account.

In a printer in which the print mode does not change and the carriage speed remains constant in an entire page (this often is the case with the ink jet printing system), there is no particular need for making corrections between the two different carriage speeds. In this case, it is possible to use the patterns of FIG. 11, which are identical to the patterns of FIG. 10 minus the pattern (J), and the correction between the different carriage speeds may not be carried out. This eliminates the need for the user to enter the inputs and still can produce the desired effect.

Further, while this embodiment has described a case where there are two print modes with different printing speeds, it is needless to say that the similar correction can effected even when more than two print modes are used.

Further, when the adjustment does not need to be performed because of the purpose of the print mode even when two or more carriage speeds can be used, e.g., when a mode is available in which the carriage speed is increased to achieve faster printing as in a draft mode that performs trial printing, it is possible to omit the correction pattern printing to spare the user's burden or, to ask the user through a driver-user interface about whether or not to perform correction at the current carriage speed and to perform the correction only when the user chooses to do so.

THIRD EMBODIMENT

This embodiment describes patterns and a parameter inputting method, different from those of the second embodiment, when there are a plurality of carriage speeds available as in the second embodiment.

Figures 13, 13A:
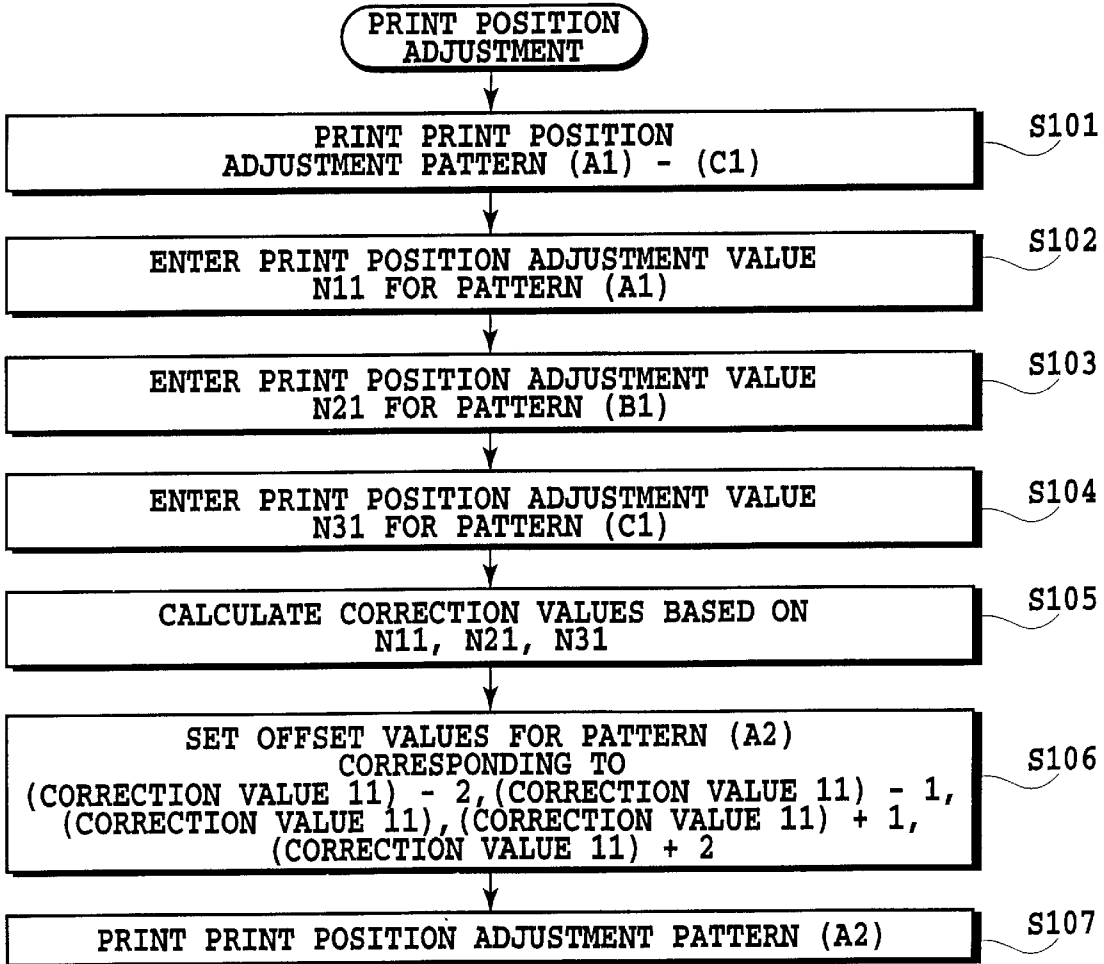
FIG. 13 is a diagram showing the relationship of FIGS. 13A and 13B.
FIG. 13A is a flow chart showing a sequence of print position correction processing according to the third embodiment of the present invention.
Figure 13B:
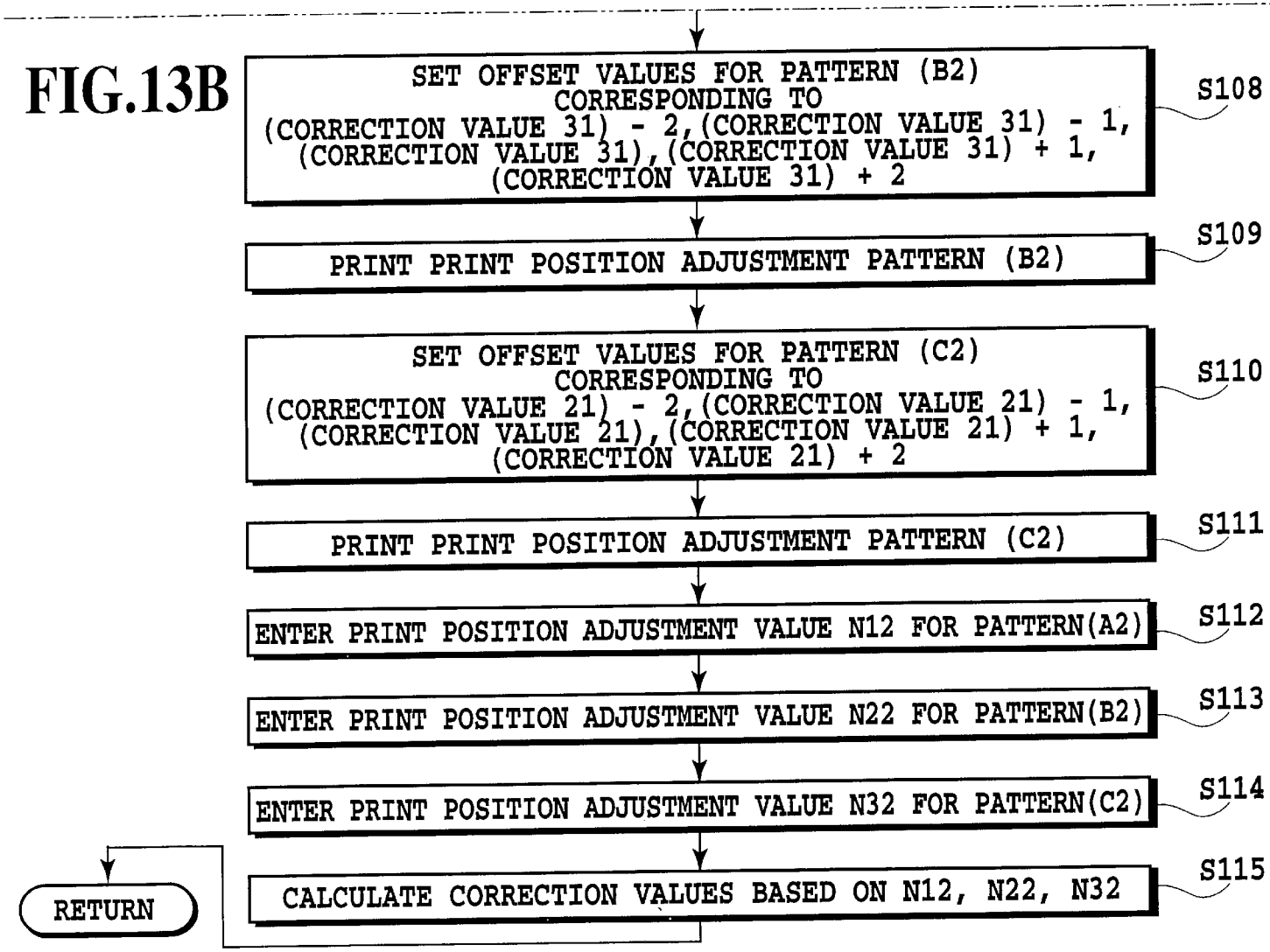
FIG. 13B is a flow chart showing a sequence of print position correction processing according to the third embodiment of the present invention.

FIGS. 12A and 12B schematically show print position adjustment patterns according to this embodiment. FIGS. 13A and 13B are flow charts showing processing for printing patterns and adjusting the print positions based on the printed patterns.

In this embodiment, the print position adjustment is performed in two stages. In FIG. 12A, the print position adjustment patterns (A1) to (C1) are similar to the patterns (D) to (F) shown in FIG. 11 of the second embodiment. They are printed at the first carriage speed and are, respectively, a print position deviation adjustment pattern printed by means of the first and second heads in the first scan direction, a print position deviation adjustment pattern printed by means of the first and second heads in the second scan direction, and a print position deviation adjustment pattern printed by means of the first head in the first and second scan directions. As shown in the flow chart of FIGS. 13A and 13B, these patterns (A1) to (C1) are printed (step S101) and the adjustment values N11, N21, N31 are entered (step S102–S104). Then, from these input values the correction values 11, 21, 31 to be used for actual printing are calculated (step S105). The adjustment values may be the correction values themselves. Next, with these correction values used as a central value of the offset range, the offset range from −2 to +2 is applied and the similar patterns (A2)–(C2) as shown in FIG. 12B are printed at the second carriage speed (step S106–S111). While in this embodiment an offset setting step is provided immediately before printing each of the patterns, these offset setting steps may be performed simultaneously with the setting of N11, N21 and N31. The offset setting is not limiting to these timings and needs only to be performed before the patterns (A2)–(C2) are printed. After the patterns (A2)–(C2) are printed, the user enters the adjust values N12, N22, N32 based on these patterns (step S112–S114) to calculate the correction values to be used in actual printing(step S115). Similarly, the adjust values may of course be the correction values themselves.

When the main cause of the position deviation between the first and second heads is, for example, a positional error between the heads that occurs as the heads are mounted on the carriage, this method produces an offset corresponding to that positional error regardless of the carriage speed. Hence, at each carriage speed, the deviation should exhibit a similar tendency to some extent. In this embodiment, by setting the offset value for the second carriage speed based on the correction value for the first carriage speed, the deviation tendency due to such a cause is corrected to some extent during the adjustment performed at the second carriage speed. This eliminates the need for increasing the offset value unnecessarily large during the adjustment performed at the second carriage speed or, when the first adjustment pattern fails to provide a sufficient offset, for changing the offset value and printing the pattern again.

Further, while this embodiment has described a case where the offset value for the second carriage speed is in the range of −2 to +2, the offset value range may be changed to −1 to +3 or the unit of offset change may be set to other than the first carriage speed according to the configuration of the product. These can apply also to other embodiments.

FOURTH EMBODIMENT

Although two heads are used in the first to third embodiments, the application of this invention is not limited to this configuration alone.

Figure 14:
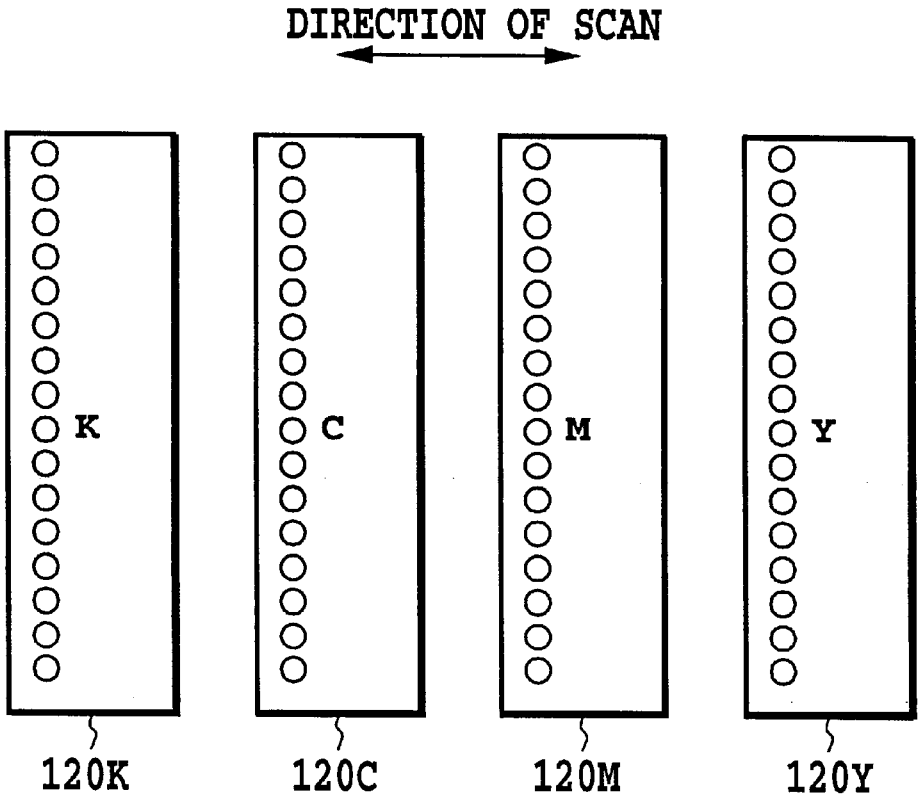
FIG. 14 is a schematic diagram showing ink nozzle sections according to a fourth embodiment of the present invention.

FIG. 14 schematically shows respective ink nozzle sections of four print heads 120K, 120C, 120M, 120Y used in this embodiment. The print heads 120K–120Y eject black, cyan, magenta and yellow inks, respectively, and are arranged in the scan direction in the order as shown in the figure. FIG. 15 is a schematic diagram showing print position adjustment patterns when the heads described above are used. The print position adjustment patterns (A1), (A2), (A3) in the figure are printed during the forward scan (in the first scan direction) by means of the print head 120K (first head) and the print heads 120C (second head), 120M (third head) and 120Y (fourth head). The print position adjustment patterns (B1), (B2), (B3) are printed during the backward scan (in the second scan direction) by means of the print head 120K and the print heads 120C, 120M and 120Y. The pattern (C1) is printed by means of the print head 120K in opposite scan directions.

As in the preceding embodiments, the user selects one of these patterns with closely overlapping lines and enters necessary inputs, thus correcting the print positions. In this way, the print positions can be corrected appropriately.

While this embodiment has described a case where the first embodiment is applied to the 4-head configuration, it is also possible to increase the number of heads in the second embodiment and still produce the similar effects. Further, the combination selected in this embodiment may be replaced with other combination while still obtaining the similar advantages.

FIFTH EMBODIMENT

While the fourth embodiment has described a case of four print heads as shown in FIG. 14, the following configurations may be possible. How this invention can be applied to such configurations will be explained below.

Figure 16A:
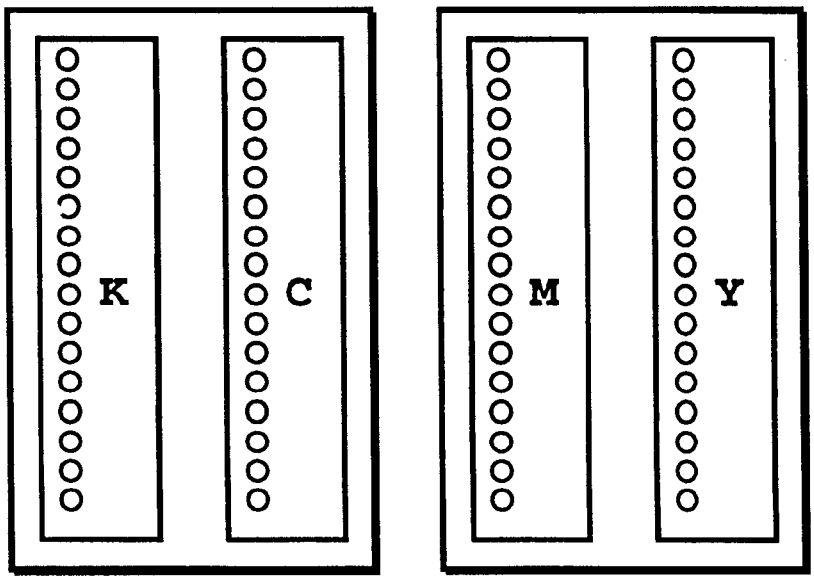
FIGS. 16A to 16C are schematic diagrams showing ink nozzle sections according to a fifth embodiment of the present invention.
Figure 16B:
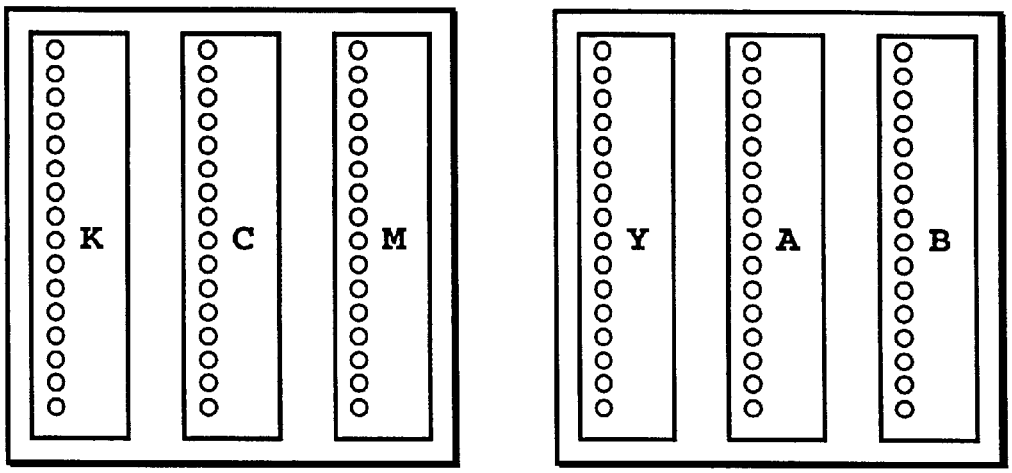
Figure 16C:
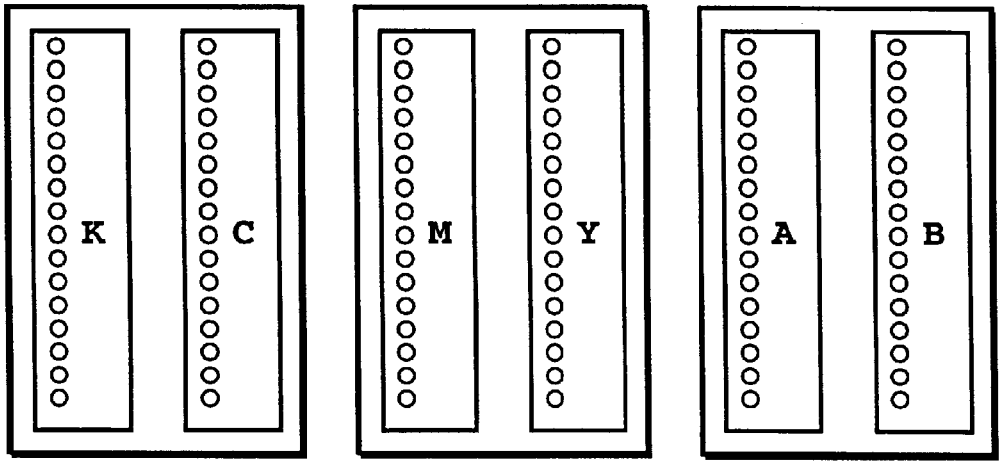

The first configuration, as shown in FIG. 16A, comprises four nozzle sections divided into two units of two nozzle sections; the second configuration comprises six nozzle sections divided into two units of three nozzle sections, as shown in FIG. 16B; and the third configuration comprises six nozzle sections divided into three units of two nozzle sections, as shown in FIG. 16C. If the nozzle sections in each unit are suitably adjusted for correct print positions at a manufacturing stage, each unit can be regarded as one head and the same consideration will hold as if these configurations have two, two and three heads, respectively. Hence, it is possible to perform the print position deviation adjustment by using a smaller number of adjustment patterns than is required by the actual number of the nozzle sections.

The number of print position deviation adjustment patterns printed in each of the foregoing embodiments can be generalized as follows. That is, let the number of scan speeds of the print heads be M ($\geqq 1$) and the number of print heads be N ($\geqq 2$). Then the number of adjustment patterns is at least (2MN−1).

More specifically, a number of combinations of two print heads selected from N print heads becomes (N−1) and the print position deviation adjustment is performed for each scan direction (two scan directions of the first and second) with respect to respective (N−1) combinations of two print heads. Further, with respect to any one of N print head, the print position deviation adjustment between the first and the second directions is performed. Accordingly, The number of print position deviation adjustment patterns becomes 2(N−1)+1=2N−1.

Further more, the above stated (2N−1) sets of print position deviation adjustment are performed with respect to respective M kinds of scan speeds. Also, a number of combinations of two kinds of scan speeds selected from M kinds of scan speeds becomes M−1, and the print position deviation adjustments are performed with respect to respective (M−1) combinations. Consequently, the number of adjustment patterns becomes M(2N−1)+(M−1)=2NM−1.

SIXTH EMBODIMENT

Figure 17:
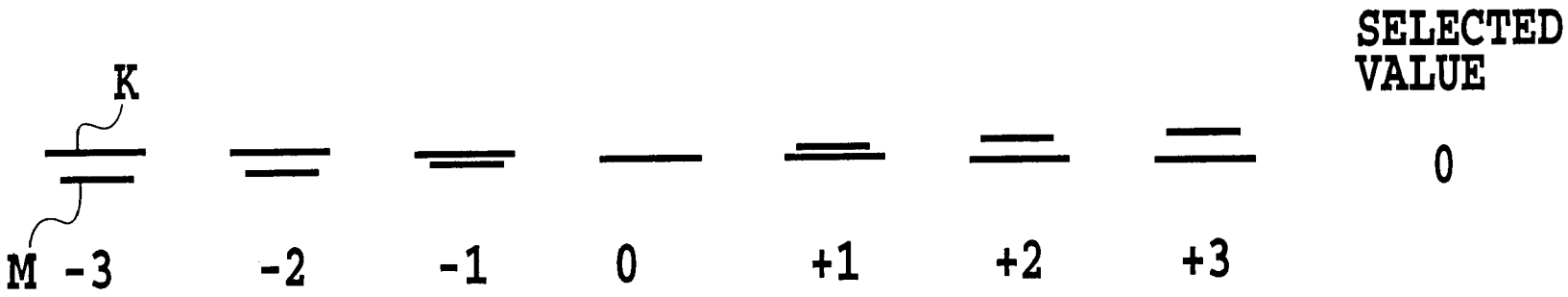
FIG. 17 is print position correction (adjust) patterns according to a sixth embodiment of the present invention.

In the first to fifth embodiment, we have explained about the method of print position registration in the print head scan direction. In the actual printing apparatus, however, the print position registration may become necessary in a direction perpendicular to the print head scan direction (subscan direction) as shown in FIG. 17. The figure shows one example of print position adjustment pattern in the sub-scan direction for two print heads as in the case of the first embodiment.

An example case taken up here uses two print heads but the number of print heads may be otherwise. The print position adjustment pattern for the head scan direction shown in each of the foregoing embodiments may be combined with this type of print adjustment pattern to form a new print position adjustment pattern. These patterns may also be arranged in the same page because there is no correlation among them and they do not pose any problem. This is advantageous for the user because it reduces the number of printing sheets used for the print position adjustment.

While the above embodiments concern cases where the ink jet print heads of the so-called bubble jet system are used, this invention can also be applied to other types of ink jet system and other types of heads, such as heat transfer and thermosensitive heads.

The present invention achieves distinct effect when applied to a printing head or a printing apparatus which has means for generating thermal energy such as electrothermal transducers or laser light, and which causes changes in ink by the thermal energy so as to eject ink. This is because such a system can achieve a high density and high resolution printing.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet printing systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to printing information; second, the thermal energy induces sudden temperature rise that exceeds the nucleate boiling so as to cause the film boiling on heating portions of the printing head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better printing.

U.S. Pat. Nos. 4,558,333 and 4,459,600 disclose the following structure of a printing head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 59-123670 (1984) and 59-138461 (1984) in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the printing head, the present invention can achieve printing positively and effectively.

In addition, the present invention can be applied to various serial type printing heads: a printing head fixed to the main assembly of a printing apparatus; a conveniently replaceable chip type printing head which, when loaded on the main assembly of a printing apparatus, is electrically connected to the main assembly, and is supplied with ink therefrom; and a cartridge type printing head integrally including an ink reservoir.

It is further preferable to add a recovery system, or a preliminary auxiliary system for a printing head as a constituent of the printing apparatus because they serve to make the effect of the present invention more reliable. Examples of the recovery system are a capping means and a cleaning means for the printing head, and a pressure or suction means for the printing head. Examples of the preliminary auxiliary system are a preliminary heating means utilizing electrothermal transducers or a combination of other heater elements and the electrothermal transducers, and a means for carrying out preliminary ejection of ink independently of the ejection for printing. These systems are effective for reliable printing.

The number and type of printing heads to be mounted on a printing apparatus can be also changed. For example, only one printing head corresponding to a single color ink, or a plurality of printing heads corresponding to a plurality of inks different in color or concentration can be used. In other words, the present invention can be effectively applied to an apparatus having at least one of the monochromatic, multi-color and full-color modes. Here, the monochromatic mode performs printing by using only one major color such as black. The multi-color mode carries out printing by using different color inks, and the full-color mode performs printing by color mixing.

Furthermore, although the above-described embodiments use liquid ink, inks that are liquid when the printing signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the printing medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the printing signal. In such cases, the ink may be retained in recesses or through holes formed in a porous sheet as liquid or solid substances so that the ink faces the electrothermal transducers as described in Japanese Patent Application Laying-open Nos. 54-56847 (1979) or 60-71260 (1985). The present invention is most effective when it uses the film boiling phenomenon to expel the ink.

Furthermore, the ink jet printing apparatus of the present invention can be employed not only as an image output terminal of an information processing device such as a computer, but also as an output device of a copying machine including a reader, and as an output device of a facsimile apparatus having a transmission and receiving function.

With the above described embodiments of the present invention, at least (2NM−1) kinds of print position deviation adjustment patterns, each with a different combination of print head, scan direction or a scan speed, are printed. These adjustment patterns can be used, for example, as the adjustment patterns for the print position deviation between a plurality of print heads in each of the forward and backward scan directions. Based on these patterns, it is possible to correct the position deviation between a plurality of print heads in each scan direction. These patterns can also be used as the adjustment patterns for print position deviation of one of the print heads between the forward scan and the backward scan. Based on the latter patterns, it is possible to correct the position deviation of one print head between the forward scan and backward scan. These patterns allow adjustment of the print position deviation between a plurality of print heads and also of the print position deviation for each print head between the forward scan and the backward scan.

As a result, it is possible to perform printing with a low cost and suppressed print position deviation without improving precision in manufacturing the printing apparatus.

The present invention has been described in detail with respect to preferred embodiments, and it will now be apparent from the foregoing to those skilled in the art that changes and modifications may be made without departing from the invention in its broader aspect, and it is the invention, therefore, in the apparent claims to cover all such changes and modifications as fall within the true spirit of the invention.

What is claimed is:

1. A printing apparatus which uses a plurality of print heads and reciprocally scans the plurality of print heads at least at one kind of speed mode to perform printing, and for which correcting print positions of the plurality of print heads is performed, said apparatus comprising:

adjustment pattern printing means for printing at least (2NM−1) kinds of print position deviation adjustment patterns, which include a combination of (N−1) kinds of print position deviation adjustment patterns with respect to (N−1) sets of two print heads selected from N print heads for adjusting a print position deviation between the two print heads of each of said (N−1) sets of two print heads for each scan direction and a print position deviation adjustment pattern for adjusting a print position deviation for one print head between the different scan directions, where M (≧1) is a number of scan speeds of a print head subjected to correcting the print positions and N (≧2) is a number of print heads;

calculating means for calculating a correction value for the print positions of the plurality of print heads based on inputs according to the at least (2NM−1) kinds of print position deviation adjustment patterns printed by said adjustment pattern printing means; and correcting means for correcting the print positions of the plurality of print heads based on the correction value calculated by said calculating means.

2. A printing apparatus as claimed in claim 1, wherein each of the plurality of print heads utilizes thermal energy to produce bubbles in ink and ejects the ink by a pressure of the bubbles to enable printing.

3. A printing apparatus as claimed in claim 2, further comprising:

means for correcting print positions of the plurality of print heads in a sub-scan direction.

4. A printing apparatus as claimed in claim 1, wherein the (2NM−1) kinds of print position deviation adjustment patterns printed by said adjustment pattern printing means include M(2N−1) kinds of print position deviation adjustment patterns which are made by printing the combination of the (N−1) kinds of print position deviation adjustment patterns and the print position deviation adjustment pattern for adjusting the print position deviation for one print head between the different scan directions for each of M kinds of scan speeds, and further include (M−1) kinds of print position deviation adjustment patterns which are printed with respect to (M−1) sets of two kinds of speeds selected from the M kinds of scan speeds.

5. A printing apparatus which uses a plurality of print heads and scans the plurality of print heads at a plurality of kinds of speed modes to perform printing, and for which correcting print positions of the plurality of print heads is performed, said apparatus comprising:

first adjustment pattern printing means for printing at least (N−1) kinds of print position deviation adjustment patterns at one of a plurality of kinds of scan speeds subjected to correcting the print positions, where N (≧2) is a number of a plurality of print heads;

second adjustment pattern printing means for printing at least (N−1) kinds of print position deviation adjustment patterns at another of the plurality of kinds of scan speeds after the print positions of the plurality of print heads have been corrected based on inputs according to the at least (N−1) kinds of print position deviation adjustment patterns printed by said first adjustment pattern printing means;

calculating means for calculating a correction value for the print positions of the plurality of print heads based on inputs according to the at least (N−1) kinds of print position deviation adjustment patterns printed by said second adjustment pattern printing means; and correcting means for correcting the print positions of the plurality of heads based on the correction value calculated by said calculating means.

6. A printing apparatus as claimed in claim 5, wherein each of the plurality of print heads utilizes thermal energy to produce bubbles in ink and ejects the ink by a pressure of the bubbles to enable printing.

7. A printing apparatus as claimed in claim 6, further comprising:

a means for correcting print positions of the plurality of print heads in a sub-scan direction.

8. A printing apparatus as claimed in claim 5, wherein said first adjustment pattern printing means and said second adjustment pattern printing means select each of M kinds of the scan speed to be either the one of a plurality of kinds of scan speeds or the other of the plurality of kinds of scan speeds so as to print (N−1) kinds of print position deviation adjustment patterns for adjusting a print position deviation between two print heads for each scan direction with respect to the one and the other of the plurality of kinds of scan speeds and a print position deviation adjustment pattern for adjusting a print position deviation between respective scan directions with respect to one print head.

9. A print position correcting method for a printing apparatus which uses a plurality of print heads and reciprocally scans the plurality of print heads at least at one kind of speed mode to perform printing, and for which correcting print positions of the plurality of print heads is performed, said method comprising the steps of:

printing at least (2NM−1) kinds of print position deviation adjustment patterns, which include a combination of (N−1) kinds of print position deviation adjustment patterns with respect to (N−1) sets of two print heads selected from N print heads for adjusting a print position deviation between the two print heads of each of said (N−1) sets of two print heads for each scan direction and a print position deviation adjustmant pattern for adjusting a print position deviation for one print head between the different scan directions, where M (≧1) is a number of scan speeds of a print head subjected to correcting the print positions and N (≧2) is a number of print heads;

calculating a correction value for the print positions of the plurality of print heads based on inputs according to the at least (2NM−1) kinds of print position deviation adjustment patterns printed in the adjustment pattern printing step; and correcting the print positions of the plurality of print heads based on the correction value calculated in the calculating step.

10. A print position correcting method as claimed in claim 9, wherein each of the plurality of print heads utilizes thermal energy to produce bubbles in ink and ejects the ink by a pressure of the bubbles to enable printing.

11. A print position correcting method as claimed in claim 10, further comprising:

a step for correcting print positions of the plurality of print heads in a sub-scan direction.

12. A print position correcting method as claimed in claim 9, wherein the (2NM−1) kinds of print position deviation adjustment patterns printed by the printing step include M(2N−1) kinds of print position deviation adjustment patterns which are made by printing the combination of the (N−1) kinds of print position deviation adjustment patterns and the print position deviation adjustment pattern for adjusting the print position deviation for one print head between the different scan directions for each of M kinds of scan speeds, and further include (M−1) kinds of print position deviation adjustment patterns which are printed with respect to (M−1) sets of two kinds of speeds selected from the M kinds of scan speeds.

13. A print position correcting method for a printing apparatus which uses a plurality of print heads and scans the plurality of print heads at a plurality of kinds of speed modes to perform printing, and for which correcting print positions of the plurality of print heads is performed, said method comprising the steps of:

printing at least (N−1) kinds of first print position deviation adjustment patterns at one of a plurality of kinds of scan speeds subjected to correcting the print positions, where N (≧2) is a number of a plurality of print heads;

printing at least (N−1) kinds of second print position deviation adjustment patterns at another of the plurality of kinds of scan speeds after the print positions of the plurality of print heads have been corrected based on inputs according to the at least (N−1) kinds of first print position deviation adjustment patterns printed in said step for printing first adjustment patterns;

calculating a correction value for the print positions of the plurality of print heads based on inputs according to the at least (N−1) kinds of second print position deviation adjustment patterns printed in said step for printing second adjustment patterns; and correcting the print positions of the plurality of heads based on the correction value calculated in said calculating step.

14. A print position correcting method as claimed in claim 13, wherein each of the plurality of print heads utilizes thermal energy to produce bubbles in ink and ejects the ink by a pressure of the bubbles to enable printing.

15. A print position correcting method as claimed in claim 14, further comprising:

a step for correcting print positions of the plurality of print heads in a sub-scan direction.

16. A print position correcting method as claimed in claim 13, wherein said step for printing first adjustment patterns and said step for printing second adjustment patterns select each of M kinds of the scan speed to be either the one of a plurality of kinds of scan speeds or the other of the plurality of kinds of scan speeds so as to print (N−1) kinds of print position deviation adjustment patterns for adjusting a print position deviation between two print heads for each scan direction with respect to the one and the other of the plurality of kinds of scan speeds and a print position deviation adjustment pattern for adjusting a print position deviation between respective scan directions with respect to one print head.

17. A computer program element of a print position correcting processing for a printing apparatus which uses a plurality of print heads and reciprocally scans the plurality of print heads at least at one kind of speed mode to perform printing, and for which correcting print positions of the plurality of print heads is performed, said program element comprising:

computer program code means to make the computer execute printing at least (2NM−1) kinds of print position deviation adjustment patterns, which include a combination of (N−1) kinds of print position deviation adjustment patterns with respect to (N−1) sets of two print heads selected from N print heads for adjusting a print position deviation between the two print heads of each of said (N−1) sets of two print heads for each scan direction and a print position deviation adjustment pattern for adjusting a print position deviation for one print head between the different scan directions, where M (≧1) is a number of scan speeds of a print head subjected to correcting the print positions and N (≧2) is a number of print heads;

calculating a correction value for the print positions of the plurality of print heads based on inputs according to the at least (2NM−1) kinds of print position deviation adjustment patterns printed in said adjustment pattern printing process; and correcting the print positions of the plurality of print heads based on the correction value calculated in said calculating process.

18. A computer program element of a print position correcting processing for a printing apparatus which uses a plurality of print heads and scans the plurality of print heads at a plurality of kinds of speed modes to perform printing, and for which correcting print positions of the plurality of print heads is performed, said program element comprising:

computer program code means to make the computer execute printing at least (N−1) kinds of first print position deviation adjustment patterns at one of a plurality of kinds of scan speeds subjected to correcting the print positions, where N (≧2) is a number of a plurality of print heads;

printing at least (N−1) kinds of second print position deviation adjustment patterns at another of the plurality of kinds of scan speeds after the print positions of the plurality of print heads have been corrected based on inputs according to the at least (N−1) kinds of first print position deviation adjustment patterns printed in said process for printing first adjustment patterns;

calculating a correction value for the print positions of the plurality of print heads based on inputs according to the at least (N−1) kinds of second print position deviation adjustment patterns printed in said process for printing second adjustment patterns; and correcting the print positions of the plurality of heads based on the correction value calculated in said calculating process.

* * * * *

UNITED STATES PATENT AND TRADEMARK OFFICE

CERTIFICATE OF CORRECTION

PATENT NO. : 6,334,720 B1
DATED : January 1, 2002
INVENTOR(S) : Masao Kato et al.

It is certified that error appears in the above-identified patent and that said Letters Patent is hereby corrected as shown below:

DRAWINGS,
Fig. 9, "N1, N2, 13" should read -- N1, N2, N3 --.

Column 3,
Line 21, "to" should read -- for --.

Column 4,
Line 27, "mode" should read -- modes --:
Line 41, "patters" should read -- patterns --; and
Line 64, "head-subjected" should read -- head subjected --.

Column 5,
Lines 10 and 62, "mode" should read -- modes --;
Line 23, "patters" should read -- patterns --;
Line 42, "to print" should read -- printing --;
Line 50, "to calculate" should read -- calculating --; and
Line 55, "to correct" should read -- correcting --.

Column 6,
Lines 1 and 5, "to print" should read -- printing --;
Line 10, "patters" should read -- patterns --;
Line 12, "to calculate" should read -- calculating --;
Line 17, "to correct" should read -- correcting --; and
Line 53, "invention" should read -- invention; --.

Column 7,
Line 38, "jet-printing" should read -- jet printing --; and
Line 61, "a" should be deleted.

Column 8,
Line 27, "At" should read -- In --; and
Line 50, "above described" should read -- above-described --.

Column 9,
Lines 23 and 41, "is" should read -- are --;
Line 49, "N2(in" should read -- N2 (in --; and
Line 57, "+3(step" should read -- +3 (step --.

UNITED STATES PATENT AND TRADEMARK OFFICE

CERTIFICATE OF CORRECTION

PATENT NO. : 6,334,720 B1
DATED : January 1, 2002
INVENTOR(S) : Masao Kato et al.

It is certified that error appears in the above-identified patent and that said Letters Patent is hereby corrected as shown below:

Column 10,
Line 5, "and-thus" should read -- and thus --;
Line 8, "above described" should read -- above-described --;
Line 29, "achieves" should read -- achieve --; and
Line 45, "give" should read -- gives --.

Column 11,
Line 51, "can" should read -- can be --.

Column 12,
Line 52, "value" should read -- value, --

Column 13,
Line 27, "combination" should read -- combinations --;
Line 45, "two, two" should read -- two --;
Line 60, "head," should read -- heads, --;
Line 62, "The" should read -- the --;
Line 65, "Further more, the above stated" should read -- Furthermore, the above-stated; and
Line 66, "adjustment" should read -- adjustments --.

Column 14,
Line 9, "embodiment," should read -- embodiments, --; and
Line 32, "system" should read -- systems --.

Column 15,
Line 55, "in" should read -- at --.

Column 16,
Line 16, "above described" should read -- above-described --.

Column 18,
Line 20, "adjustmant" should read -- adjustment --.

Column 19,
Line 43, "execute" should read -- execute; --.

UNITED STATES PATENT AND TRADEMARK OFFICE

CERTIFICATE OF CORRECTION

PATENT NO. : 6,334,720 B1
DATED : January 1, 2002
INVENTOR(S) : Masao Kato et al.

It is certified that error appears in the above-identified patent and that said Letters Patent is hereby corrected as shown below:

Column 20,
Line 26, "execute" should read -- execute; --.

Signed and Sealed this

Second Day of August, 2005

JON W. DUDAS
*Director of the United States Patent and Trademark Office*